US010544712B1

(12) United States Patent
Nagaraj et al.

(10) Patent No.: US 10,544,712 B1
(45) Date of Patent: Jan. 28, 2020

(54) FINGER FOLLOWER WITH OIL SPRAY HOLE

(71) Applicant: Schaeffler Technologies AG & Co. KG, Herzogenaurach (DE)

(72) Inventors: Sumukha Nagaraj, Beverly Hills, MI (US); David Chandler, Windsor (CA)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/102,943

(22) Filed: Aug. 14, 2018

(51) Int. Cl.
*F01L 1/18* (2006.01)
*F01L 1/24* (2006.01)
*F01L 13/00* (2006.01)

(52) U.S. Cl.
CPC ..... *F01L 1/185* (2013.01); *F01L 1/2405* (2013.01); *F01L 13/0036* (2013.01); *F01L 2001/186* (2013.01); *F01L 2001/187* (2013.01); *F01L 2105/00* (2013.01); *F01L 2810/02* (2013.01)

(58) Field of Classification Search
CPC ..... F01L 1/185; F01L 13/0036; F01L 1/2405; F01L 2001/186; F01L 2810/02; F01L 2001/187; F01L 2105/00; F01L 13/0005
USPC ..... 123/90.39, 90.16
See application file for complete search history.

(56) References Cited

U.S. PATENT DOCUMENTS

| | | | | |
|---|---|---|---|---|
| 9,115,609 | B2 * | 8/2015 | Manther | F01L 1/181 |
| 2003/0111031 | A1 * | 6/2003 | Hendricksma | F01L 1/18 123/90.15 |
| 2014/0182539 | A1 * | 7/2014 | Gron, Jr. | F01L 13/08 123/182.1 |

FOREIGN PATENT DOCUMENTS

| | | | | |
|---|---|---|---|---|
| DE | 4234868 | C2 | 4/1994 | |
| DE | 10316189 | A1 * | 10/2004 | F01L 1/18 |
| DE | 102012221661 | A1 | 5/2014 | |
| DE | 102015214026 | A1 | 1/2017 | |

* cited by examiner

*Primary Examiner* — Mark A Laurenzi
*Assistant Examiner* — Wesley G Harris

(57) ABSTRACT

A switching roller finger follower, including: first and second body portions; a resilient element connected to the body portions; and a locking assembly. The first body portion includes: a first bore; a second bore including a first orifice arranged to receive a pressurized fluid; and a second orifice arranged to expel the fluid. The locking assembly includes: a locking pin disposed in the first bore; and a shuttle pin engaged with the locking pin. The shuttle pin is displaceable transverse to the locking pin to: displace the locking pin in a first axial direction to contact the second body portion with the locking pin; and displace the locking pin in a second axial direction to disengage the locking pin from the second body portion. The second bore includes the second orifice; or the second bore does not include the second orifice and is in fluid communication with the second orifice.

20 Claims, 20 Drawing Sheets

FINGER FOLLOWER WITH OIL SPRAY HOLE

TECHNICAL FIELD

The present disclosure relates to a finger follower with an oil spray hole.

BACKGROUND

A known switchable roller finger follower includes a cam roller that is contacted by a cam shaft lobe. It would be desirable to provide additional lubrication to the interface of the cam shaft lobe and the cam roller.

SUMMARY

According to aspects illustrated herein, there is provided a switching roller finger follower, including: a first body portion; a second body portion; a pin pivotably connecting the second body portion to the first body portion; at least one first resilient element connected to the first body portion and to the second body portion; and a locking assembly. The first body portion includes: a first bore including a first longitudinal axis; an outer surface; a second bore including a first orifice in the outer surface, the first orifice arranged to receive a pressurized fluid; and a second orifice in the outer surface, the second orifice arranged to expel the pressurized fluid. The locking assembly includes: a locking pin at least a portion of which is disposed in the first bore; and a shuttle pin transverse to the locking pin and engaged with the locking pin. The shuttle pin is arranged to be displaced transverse to the locking pin to: displace the locking pin in a first axial direction, parallel to the first longitudinal axis, to contact the second body portion with the locking pin; and displace the locking pin in a second axial direction, opposite the first axial direction, to disengage the locking pin from the second body portion. The second bore includes the second orifice; or the second bore does not include the second orifice and is in fluid communication with the second orifice.

According to aspects illustrated herein, there is provided a switching roller finger follower, including: a first body portion; a second body portion; a pin pivotably connecting the second body portion to the first body portion; at least one first resilient element connected to the first body portion and to the second body portion; a passageway open only at the first orifice and at the second orifice and from the first orifice to the second orifice through the groove; and a locking assembly. The first body portion includes: an outer surface; a bore; a side wall bounding the bore; a groove in the side wall; a first through-bore including a first orifice at the outer surface, the first through-bore arranged to receive a pressurized fluid; and a second through-bore including a second orifice at the outer surface, the second orifice arranged to expel the pressurized fluid. The locking assembly includes: a locking pin at least a portion of which is disposed in the bore; and a shuttle pin transverse to the locking pin and engaged with the locking pin. The shuttle pin is arranged to be displaced: in a first direction, orthogonal to the longitudinal axis, to displace the locking pin in a first axial direction, parallel to the longitudinal axis, to contact the second body portion with the locking pin; and in a second direction, opposite the first direction, to displace the locking pin in a second axial direction, opposite the first axial direction, to disengage the locking pin from the second body portion.

According to aspects illustrated herein, there is provided switching roller finger follower, including: a first body portion; a second body portion; a pin pivotably connecting the second body portion to the first body portion; at least one first resilient element connected to the first body portion and to the second body portion; and a locking assembly. The first body portion includes: an outer surface and a second bore. The second bore includes: a first orifice in the outer surface, the first orifice arranged to receive a pressurized fluid; a second orifice in the outer surface, the second orifice arranged to expel the pressurized fluid; and a second longitudinal axis, the second longitudinal axis non-co-linear with the first longitudinal axis. The locking assembly includes: a locking pin at least a portion of which is disposed in the first bore; and a shuttle pin transverse to the locking pin and engaged with the locking pin. The shuttle pin is arranged to displaced: in a first direction, orthogonal to the longitudinal axis, to displace the locking pin in a first axial direction, parallel to the longitudinal axis, to contact the second body portion with the locking pin; and in a second direction, opposite the first direction, to displace the locking pin in a second axial direction, opposite the first axial direction, to disengage the locking pin from the second body portion.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 20:
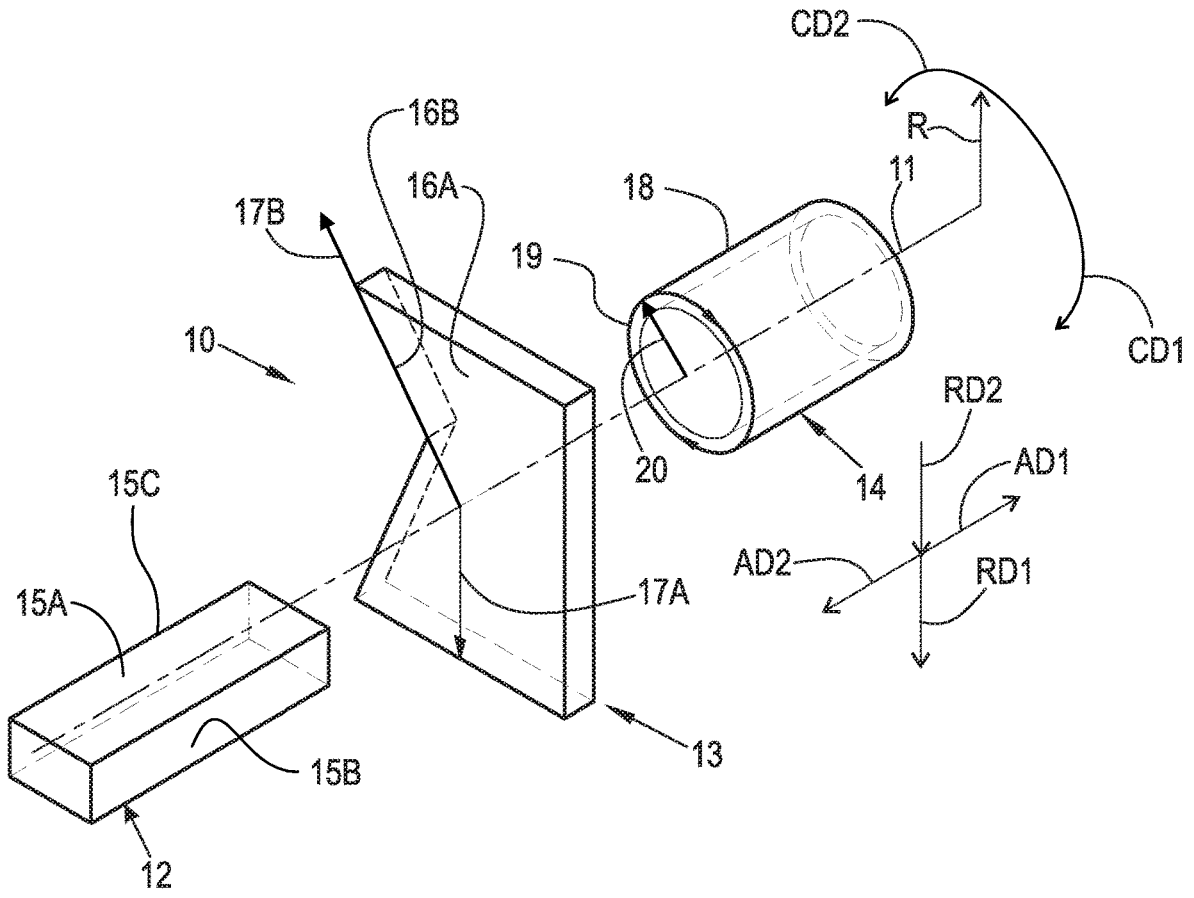

FIG. 20 is a perspective view of cylindrical coordinate system 10 demonstrating spatial terminology used in the present application. The present application is at least partially described within the context of a cylindrical coordinate system. System 10 includes axis of rotation, or longitudinal axis, 11, used as the reference for the directional and spatial terms that follow. Opposite axial directions AD1 and AD2 are parallel to axis 11. Radial direction RD1 is orthogonal to axis 11 and away from axis 11. Radial direction RD2 is orthogonal to axis 11 and toward axis 11. Opposite circumferential directions CD1 and CD2 are defined by an endpoint of a particular radius R (orthogonal to axis 11) rotated about axis 11, for example clockwise and counterclockwise, respectively.

To clarify the spatial terminology, objects 12, 13, and 14 are used. As an example, an axial surface, such as surface 15A of object 12, is formed by a plane co-planar with axis 11. However, any planar surface parallel to axis 11 is an axial surface. For example, surface 15B, parallel to axis 11 also is an axial surface. An axial edge is formed by an edge, such as edge 15C, parallel to axis 11. A radial surface, such as surface 16A of object 13, is formed by a plane orthogonal to axis 11 and co-planar with a radius, for example, radius 17A. A radial edge is co-linear with a radius of axis 11. For example, edge 16B is co-linear with radius 17B. Surface 18 of object 14 forms a circumferential, or cylindrical, surface. For example, circumference 19, defined by radius 20, passes through surface 18.

Axial movement is in axial direction AD1 or AD2. Radial movement is in radial direction RD1 or RD2. Circumferential, or rotational, movement is in circumferential direction CD1 or CD2. The adverbs "axially," "radially," and "circumferentially" refer to movement or orientation parallel to axis 11, orthogonal to axis 11, and about axis 11, respectively. For example, an axially disposed surface or edge extends in direction AD1, a radially disposed surface or edge extends in direction RD1, and a circumferentially disposed surface or edge extends in direction CD1.

Figure 1:
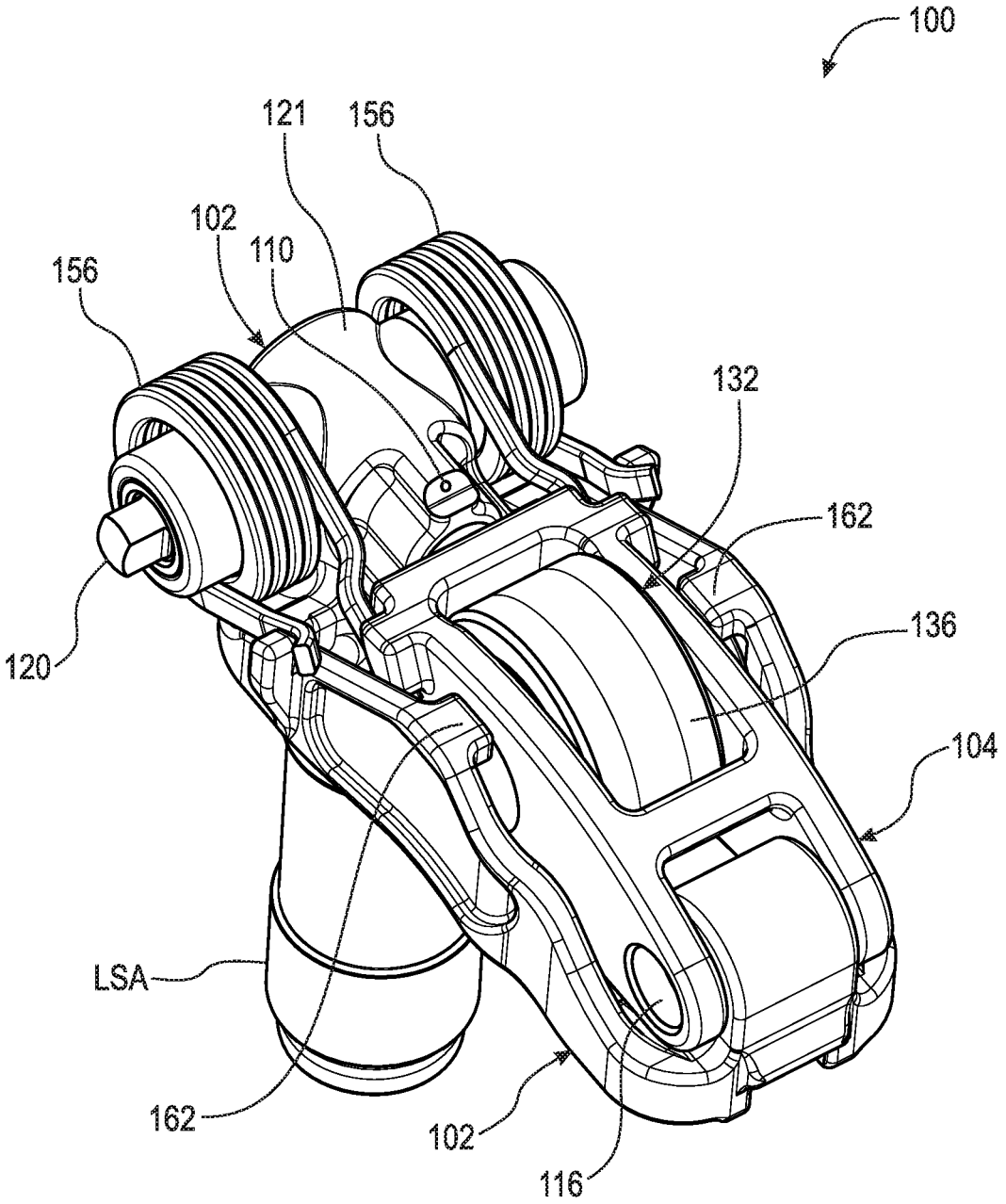
FIG. 1 is a perspective view of a switching roller finger follower with cam roller lubrication in a locked configuration, and a lash adjuster.

FIG. 1 is a perspective view of switching roller finger follower 100 with cam roller lubrication in a locked configuration, and lash adjuster LSA.

Figure 2:
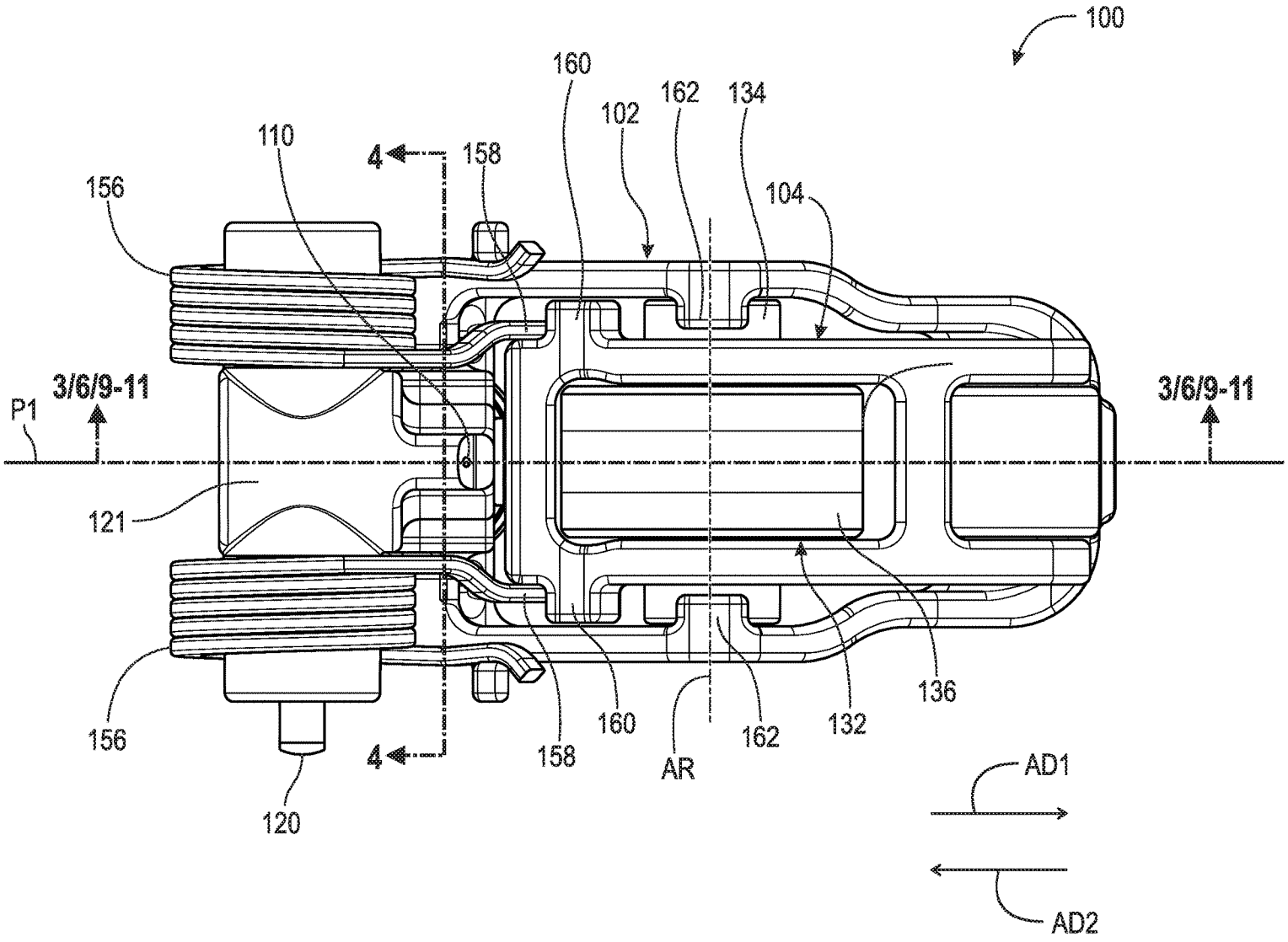
FIG. 2 is a top view of the switching roller finger follower of FIG. 1.

FIG. 2 is a top view of switching roller finger follower 100 of FIG. 1.

Figure 3:
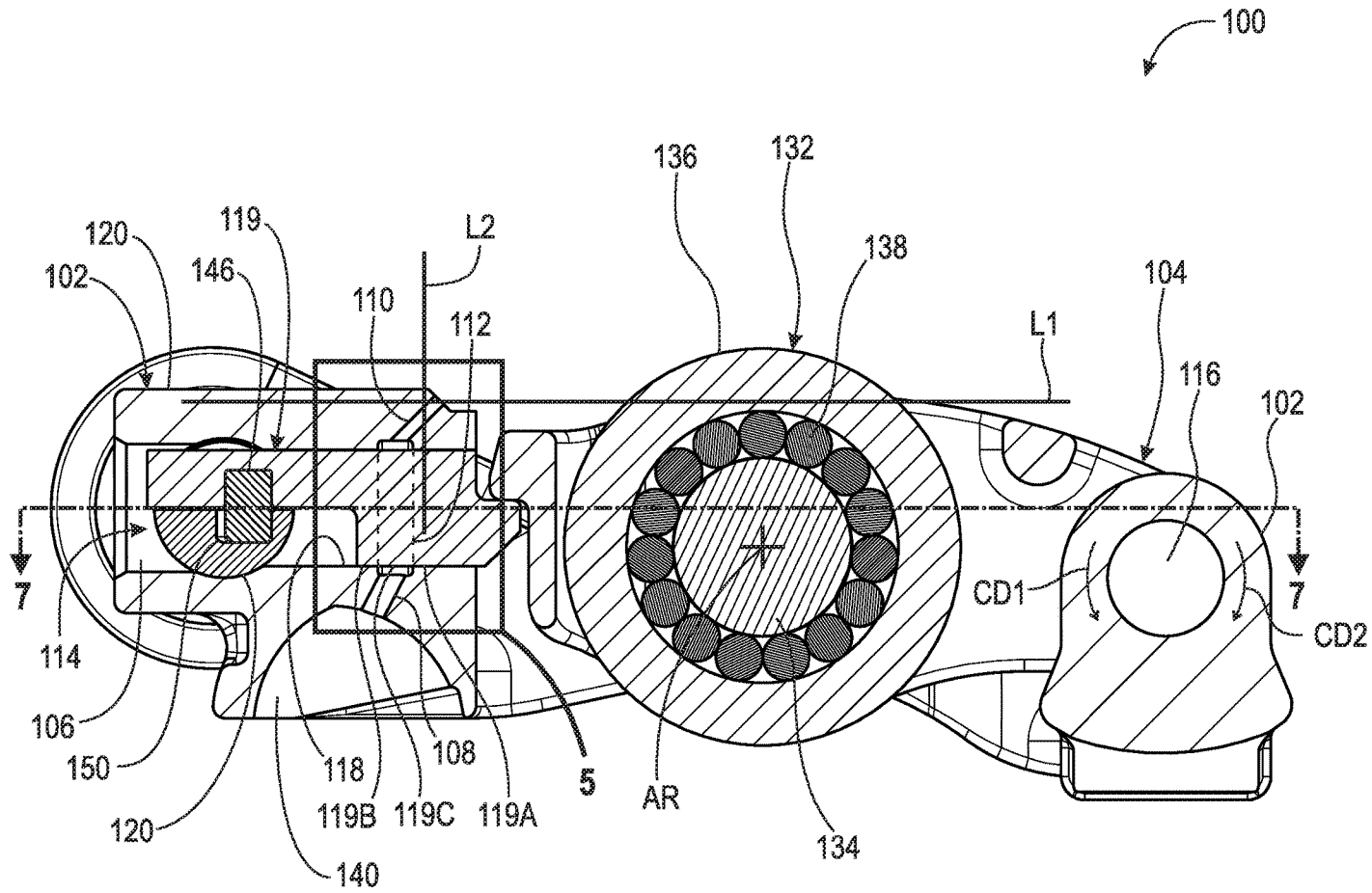
FIG. 3 is a cross-sectional view generally along line 3/6/9-11-3/6/9-11 in FIG. 1.

FIG. 3 is a cross-sectional view generally along line 3/6/9-11-3/6/9-11 in FIG. 2.

Figure 4:
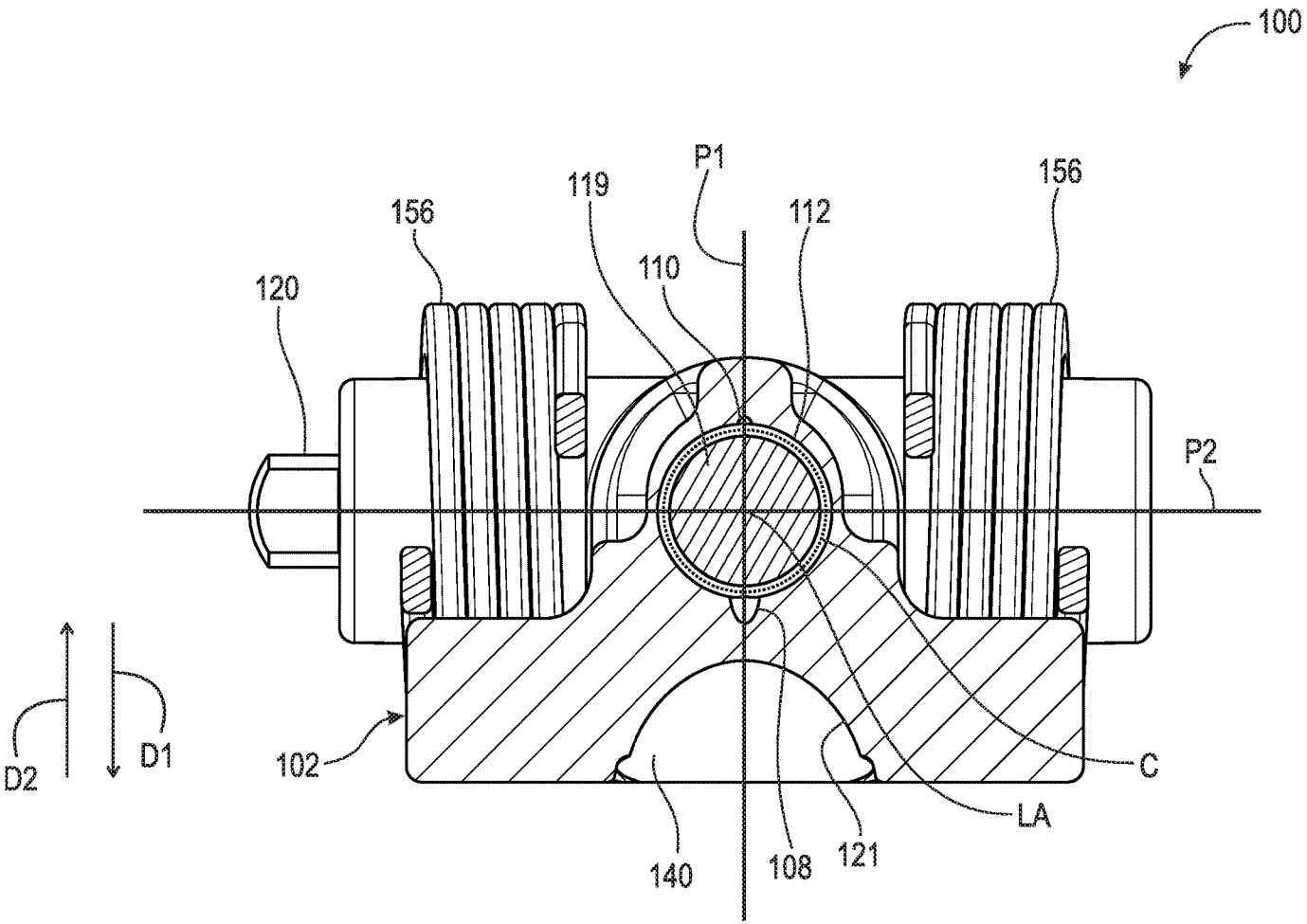
FIG. 4 is a cross-sectional view generally along line 4-4 in FIG. 2.

FIG. 4 is a cross-sectional view generally along line 4-4 in FIG. 2.

Figure 5:
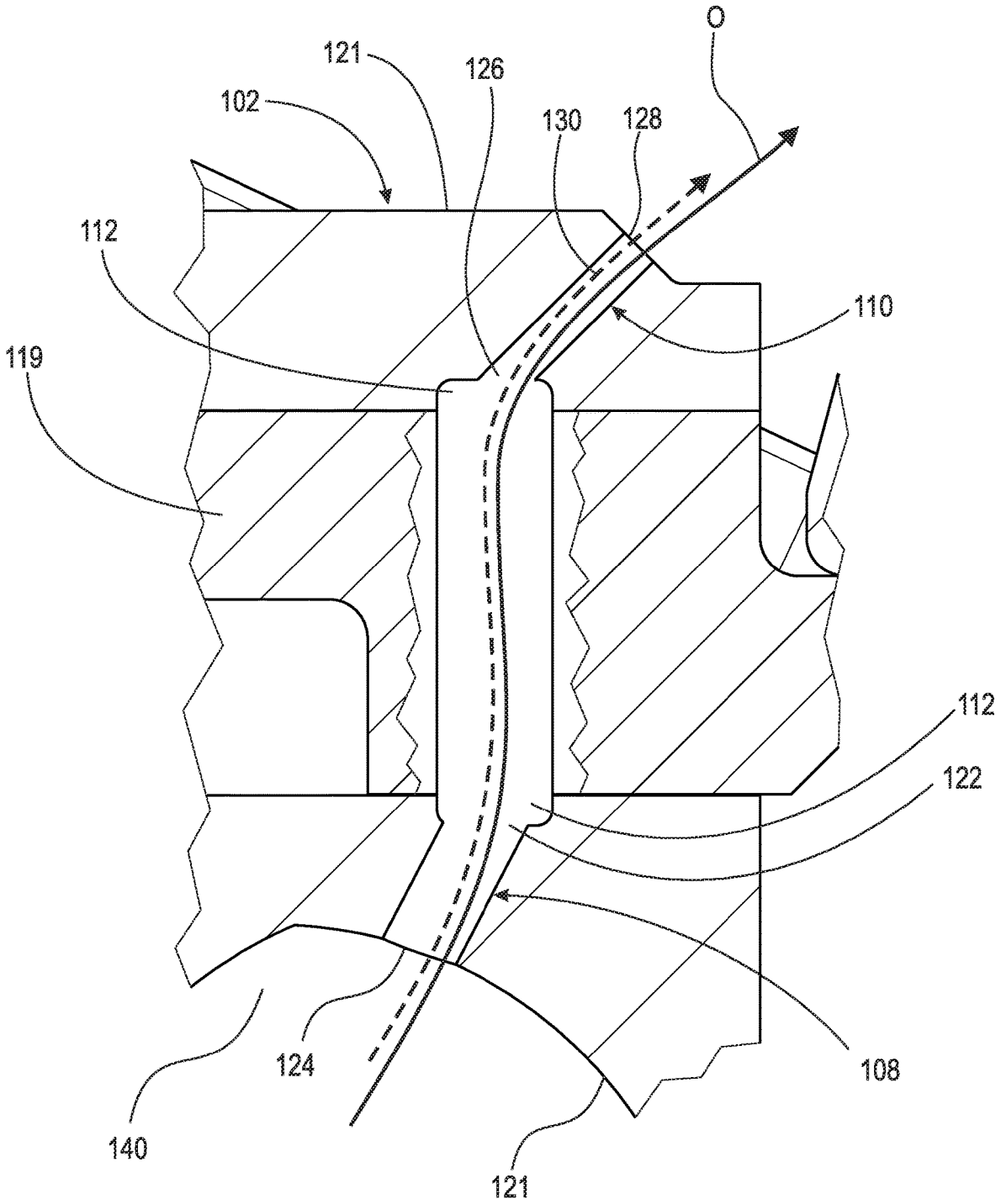
FIG. 5 is a detail of area 5 in FIG. 3 with a cut-away of a locking pin to show a groove.

FIG. 5 is a detail of area 5 in FIG. 3 with a cut-away of a locking pin to show a groove. The following should be viewed in light of FIGS. 1 through 5. Finger follower 100 includes: body portion, or lever, 102; body portion, or lever, 104; bore 106 in portion 102; through-bore 108 in portion 102; through-bore 110 in portion 102; groove 112; locking assembly 114 disposed, at least in part, in bore 106; and pin 116 pivotably connecting portion 104 to portion 102. By "bore" we mean an enclosed passageway that has at least one open end in a surface of the material enclosing the passageway. A second end may be blocked by the material enclosing the passageway. By "through-bore" we mean an enclosed passageway that has an opening or orifice, through the surface of the material enclosing the passageway, on each end of the through-bore. For example, a fluid can flow into one orifice and out the other orifice through the through-bore.

In an example embodiment, bore 106 is a through-bore. Groove 112 is formed in portion 102, in particular, in side wall 118, which bounds bore 106. Bore 106 includes longitudinal axis LA. Through-bore 108 is open to, or alternately stated connects to, groove 112 and through-bore 110 is open to, or alternately stated connects to, groove 112. Locking assembly 114 includes locking pin 119, at least a portion of which is disposed in bore 106. Switching roller finger follower 100 does not include a resilient element, such as a spring, in contact with pin 119 or through which axis LA passes. Note that more than one reference character "102" may be shown in a particular drawing to identify segments of portion 102.

Portions 119A and 119B of locking pin 119 are in contact with side wall 118 and axially bracket groove 112 ("axial" is with respect to directions parallel to axis LA). For example: portion 119A extends past groove 112 in direction AD1, parallel to axis LA; and portion 119B extends past groove 112 in direction AD2, opposite direction AD1. Portion 119C of locking pin 119 is axially disposed between portions 119A and 119B and is not in contact with side wall 118. In an example embodiment, groove 112 is circumferentially continuous about axis LA. For example, circle C, disposed in groove 112: is centered on axis LA; is orthogonal to axis LA; and does not intersect body portion 102 or pin 119. Stated otherwise, groove 112 is in the form of a continuous circle centered about axis LA. In an example embodiment (not shown), groove 112 is not circumferentially continuous about axis LA.

Figure 6:
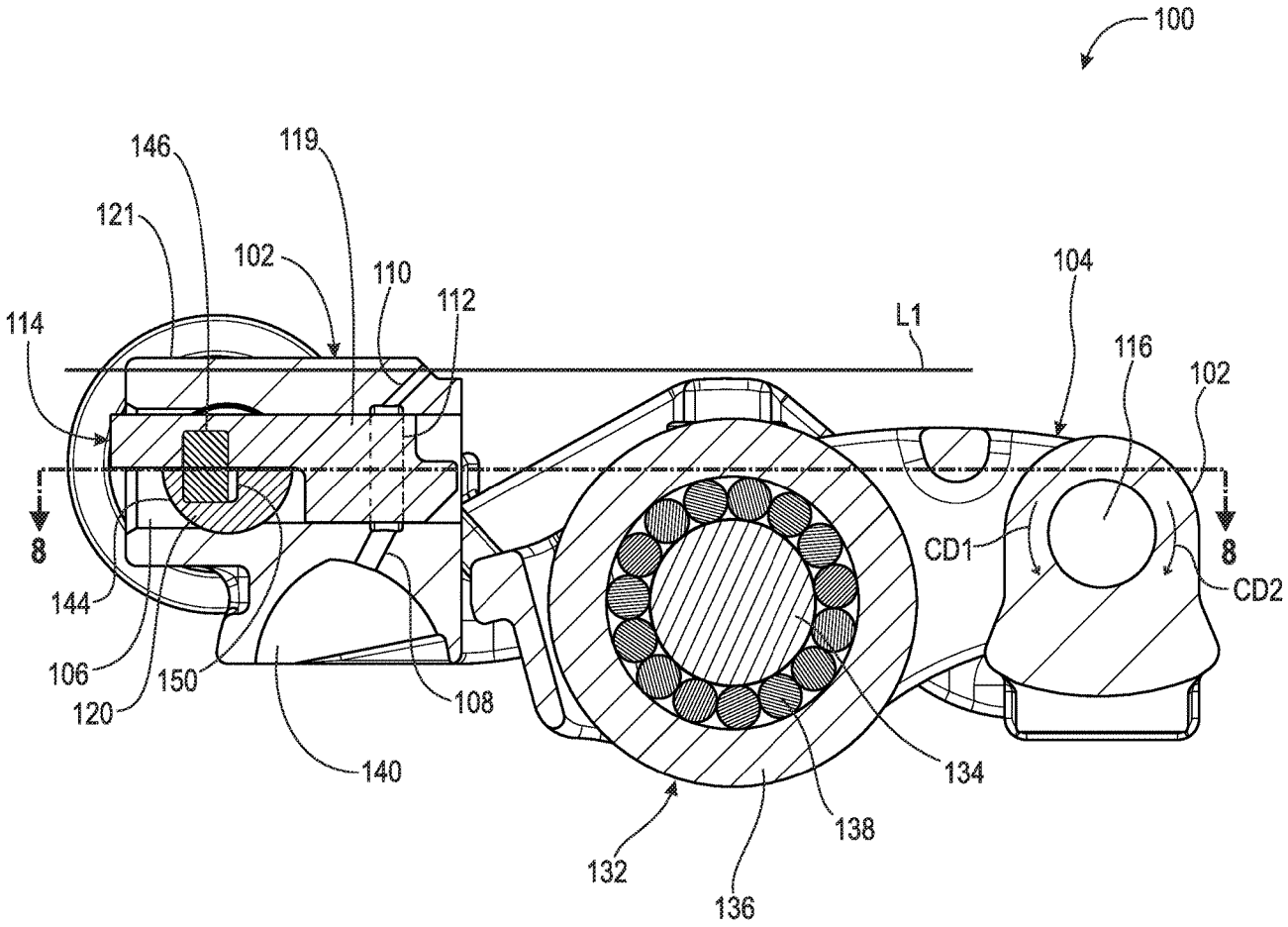
FIG. 6 is a cross-sectional view generally along line 3/6/9-11-3/6/9-11 in FIG. 2, with the switching roller finger follower in an unlocked configuration.

FIG. 6 is a cross-sectional view generally along line 3/6/9-11-3/6/9-11 in FIG. 2, with switching roller finger follower 100 in an unlocked configuration. The following should be viewed in light of FIGS. 1 through 6. Locking assembly 114 includes shuttle pin 120: transverse to locking pin 119; engaged with locking pin 119; and arranged to be displaced transverse to locking pin 119. Displacing pin 120 transverse to pin 119: displaces locking pin 119 in axial direction AD1 to contact body portion 104 with locking pin 119 (place switching roller finger follower 100 in a locked configuration); and displaces locking pin 119 in axial direction AD2 to disengage locking pin 119 from body portion 104 (place switching roller finger follower 100 in an unlocked configuration).

In the locked configuration, locking pin 119 prevents portion 104 from pivoting about pin 116, and with respect to portion 102, in circumferential direction CD1. In the unlocked configuration of switching roller finger follower 100, pin 119 does not block body portion 104 from pivoting about pin 116 and with respect to body portion 102. In an example embodiment, in the unlocked configuration, locking pin 119 is free of contact with body portion 104. It is possible for pin 116 to be fixed to portion 104 such that portion 104 and pin 116 pivot with respect to portion 102.

Body portion 102 includes outer surface 121. Through-bore 108 includes: orifice 122 open to, or alternately stated connected to, groove 112; and orifice 124 in outer surface 121. Through-bore 110 includes: orifice 126 open to, or alternately stated connected to, groove 112; and orifice 128 in outer surface 121. Orifice 122 is arranged to receive a pressurized fluid. In the discussion that follows, the pressurized fluid is assumed to be oil O. Orifice 128 is arranged to expel oil O. Continuous, or alternately stated unobstructed, passageway 130 is formed by through-bore 108, groove 112, and through-bore 110. By "continuous, or alternately stated unobstructed passageway," we mean that an open path is formed by channel 130 from orifice 124 to orifice 128, for example as further described below, oil O is able to flow from orifice 124 through passageway 130 to orifice 128. Passageway 130 is open only at orifice 124 and orifice 128. Stated otherwise, with the exception of orifices 124 and 128, passageway 130 is enclosed, or bounded, by portion 102 and pin 119. Thus, through-bore 108 is in fluid communication with orifice 128.

In the example of FIG. 1, finger follower 100 includes cam roller 132 with: axle 134 fixed to portion 104; outer race 136; and rollers 138 radially disposed between axle 134 and race 136. In the example of FIG. 1, body portion 102 includes indentation 140 arranged to receive lash adjuster LSA and orifice 124 is at indentation 140. That is, through-bore 108 opens to indentation 140 at orifice 124. In the example of FIG. 1: in the locked configuration of switching roller finger follower 100, line L1, parallel to longitudinal axis LA and passing through orifice 128, passes through cam roller 132; and in the unlocked configuration of switching roller finger follower 100, line L1 does not pass through cam roller 132. In the example of FIG. 1, in the unlocked configuration of switching roller finger follower 100, line L1 does not pass through body portion 104. In the example of FIG. 1, line L2, orthogonal to axis LA, passes through through-bore 110 and longitudinal axis LA, without passing through body portion 104.

Axle 134 includes axis of rotation AR for outer race 136. In an example embodiment, plane P1 is: orthogonal to axis AR; is co-linear with axis LA; and bisects outer race 136. Plane P2 is co-linear with longitudinal axis LA and is orthogonal to plane P1. Through-bore 108 is disposed past plane P2 in a direction D1 parallel to plane P1. Through-bore 110 is disposed past plane P2 in direction D2, opposite direction D1.

In the example of FIG. 1, plane P1 intersects pin 119, through-bore 108, and through-bore 110. Thus, through-bore 110 is separated from through-bore 108 by 180 degrees with respect to axis LA. In an example embodiment (not shown), through-bore 110 is separated from through-bore 108 by other than 180 degrees with respect to axis LA. In the example of FIG. 1, plane P1 intersects orifice 122 and orifice 126. Thus, orifice 126 is separated from orifice 122 by 180 degrees with respect to axis LA. In an example embodiment (not shown), orifice 126 is separated from orifice 122 by other than 180 degrees with respect to axis LA. In an example embodiment (not shown), plane P1 does not intersect orifice 126. In an example embodiment (not shown), plane P1 does not intersect through-bore 108. In an example embodiment (not shown), plane P1 does not intersect through-bore 110.

Locking pin 119 bounds at least a portion of groove 112 in both the locked mode and the unlocked mode. In an example embodiment, locking pin 119 bounds an entirety of groove 112 in both the locked configuration and the unlocked configuration of switching roller finger follower 100. For example, portions 119A and 119B extend 360 degrees about axis LA. Portions 119A and 119B bracket groove 112 in both the locked configuration and the unlocked configuration of switching roller finger follower 100.

Figure 7:
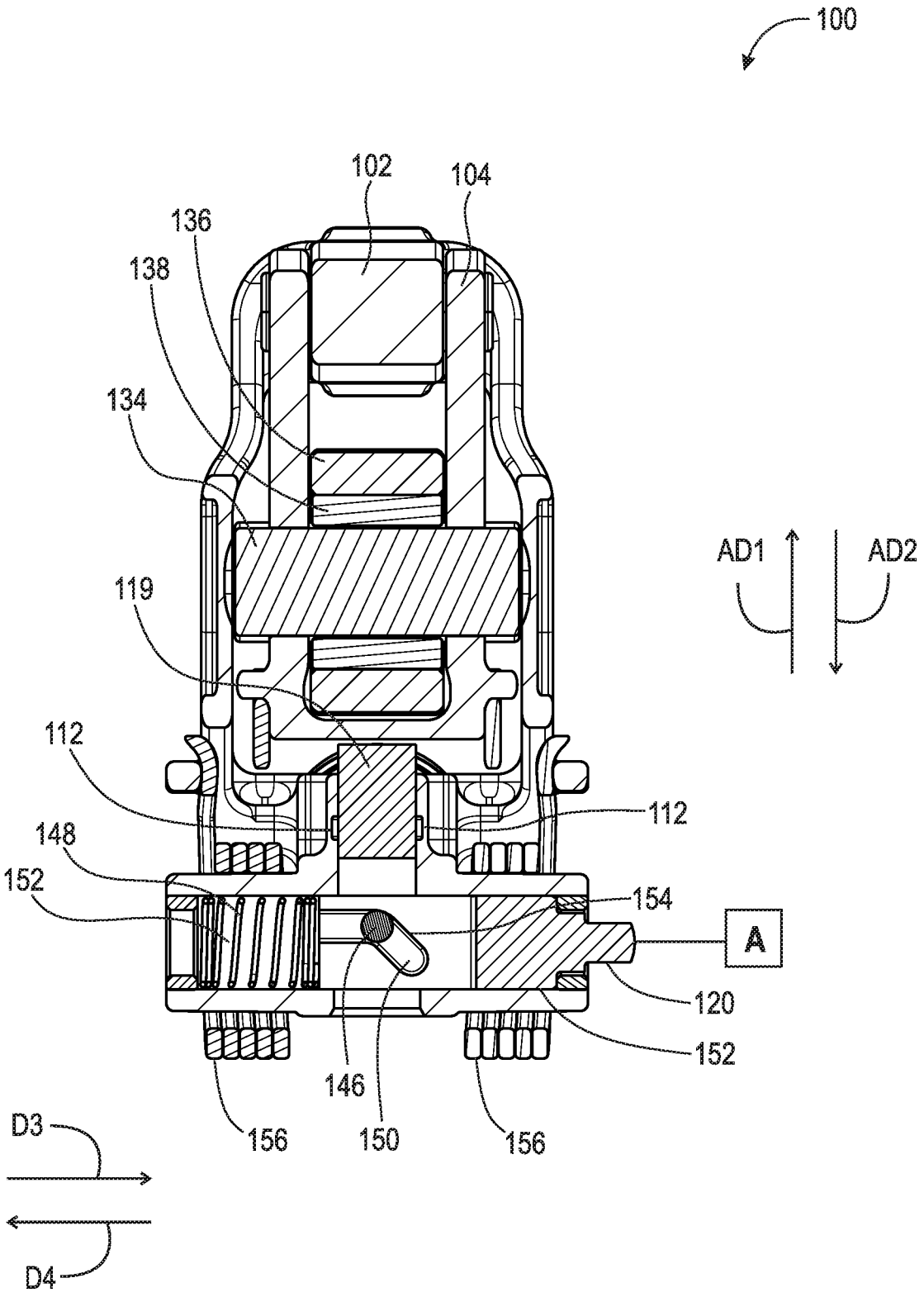
FIG. 7 is a cross-sectional view generally along line 7-7 in FIG. 3.

FIG. 7 is cross-sectional view generally along line 7-7 in FIG. 3. The following should be viewed in light of FIGS. 1 through 7. In the example of FIG. 1, locking assembly 114 includes switching pin 146 and resilient element 148. Switching pin 146 is fixedly connected to locking pin 119 and extends into ramped slot 150 in shuttle pin 120. Pin 120 is: disposed at least partly in bore 106; disposed at least partly in through-bores 152 in body portion 102; and is engaged with pin 146 via slot 150. Resilient element 148 urges shuttle pin 120 in direction D3, orthogonal to axis LA. In an example embodiment (not shown), a switching pin is fixedly connected to shuttle pin 120 and extends into a ramped slot in locking pin 119.

Figure 8:
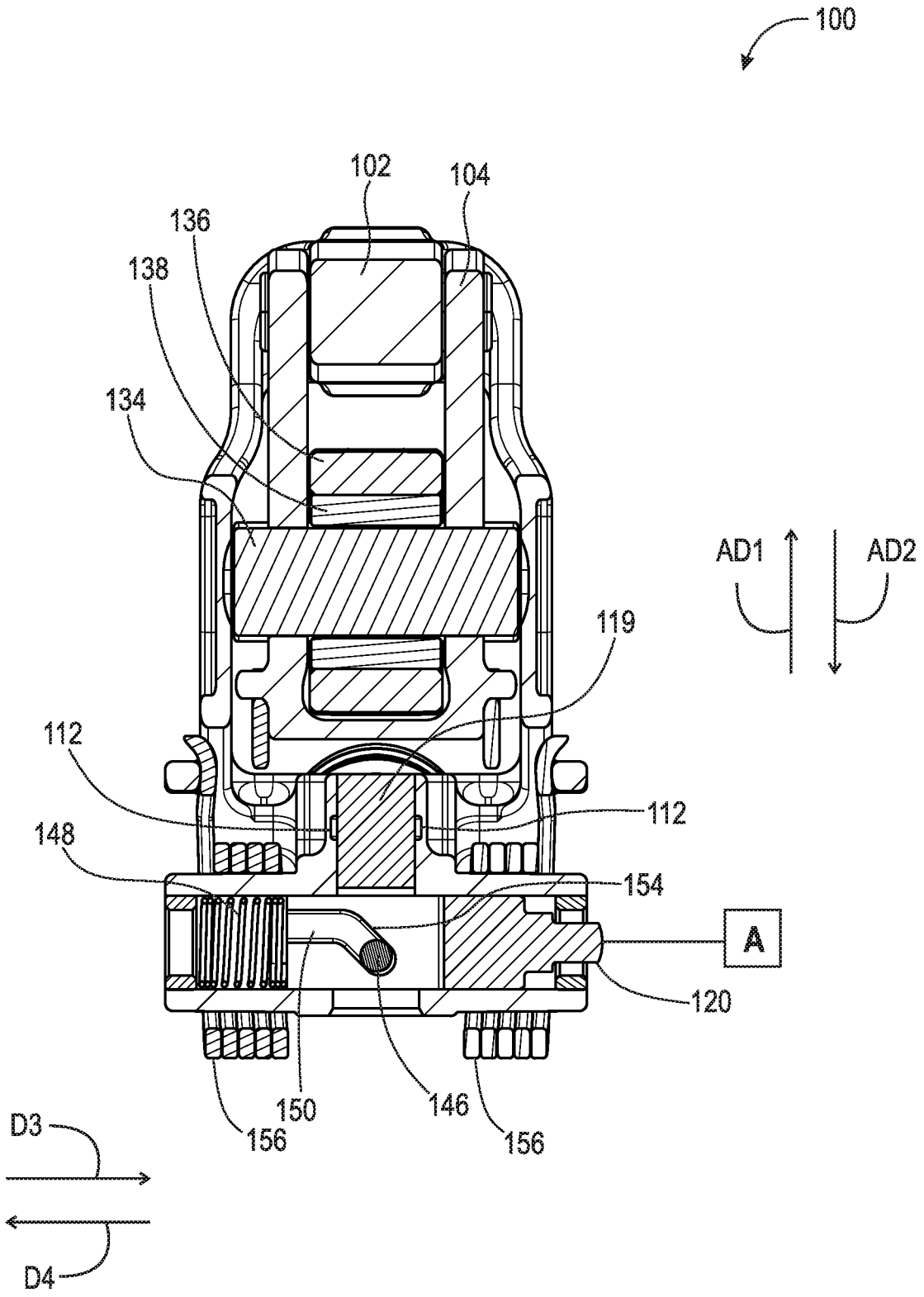
FIG. 8 is a cross-sectional view generally along line 8-8 in FIG. 6.

FIG. 8 is cross-sectional view generally along line 8-8 in FIG. 6. The following should be viewed in light of FIGS. 1 through 8. In the example of FIG. 1, follower 100 includes resilient elements 156 wrapped about body portion 102 and urging body portion 104 in direction CD1 about pin 116. In the example of FIG. 1, shuttle pin 120 is arranged to be displaced by actuator A in direction D4, opposite direction D3, against force from resilient element 148. Resilient element 148 and actuator A switch follower 100 between the locked configuration and the unlocked configuration. For example, starting in the locked configuration shown FIGS. 3 and 7, when actuator A displaces shuttle pin 120 in direction D4, contact with wall 154 of slot 150 forces pin 146 and locking pin 119 in direction AD2 and into the unlocked configuration of FIGS. 6 and 8. For example, starting in the unlocked configuration shown in FIGS. 6 and 8, when resilient element 148 displaces shuttle pin 120 in direction D3, contact with wall 154 forces pin 146 and locking pin 119 in direction AD1 and resilient elements 156 pivot body portion 104, about pin 116 and with respect to portion 102, and into the locked configuration shown FIGS. 3 and 6. Actuator A can be any actuator known in the art. In an example embodiment (not shown), resilient element 148 displaces shuttle pin 120 in direction D4 and actuator A is arranged to displace shuttle pin 120 in direction D3.

Ends 158 of resilient elements 156 contact shoulders 160 of portion 104 to urge portion 104 in circumferential direction CD2 about pin 116 and with respect to portion 102. Axle 134 contacts stops 162 in body portion 102 to limit an extent of pivoting of body portion 104 in direction CD1. As noted above and further described below, resilient elements 156 provide the force to displace body portion 104 from the position shown in FIGS. 6 and 8 to the position shown in FIGS. 3 and 7.

Figure 9:
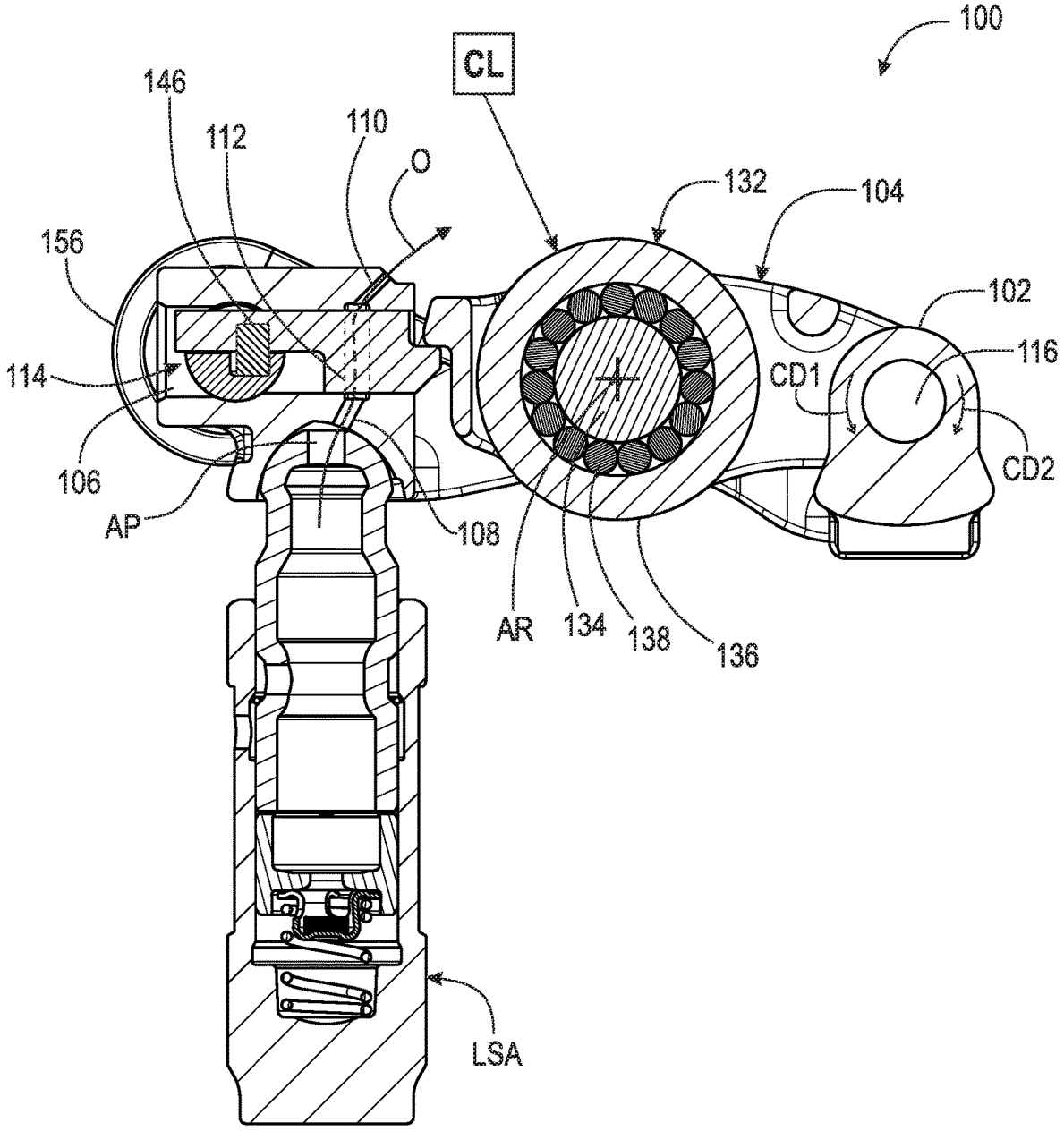
FIG. 9 is a cross-sectional view generally along line 3/6/9-11-3/6/9-11 in FIG. 2, with the switching roller finger follower in the locked configuration without valve lift.

FIG. 9 is a cross-sectional view generally along line 3/6/9-11-3/6/9-11 in FIG. 2, with switching roller finger follower 100 in the locked configuration without valve lift.

Figure 10:
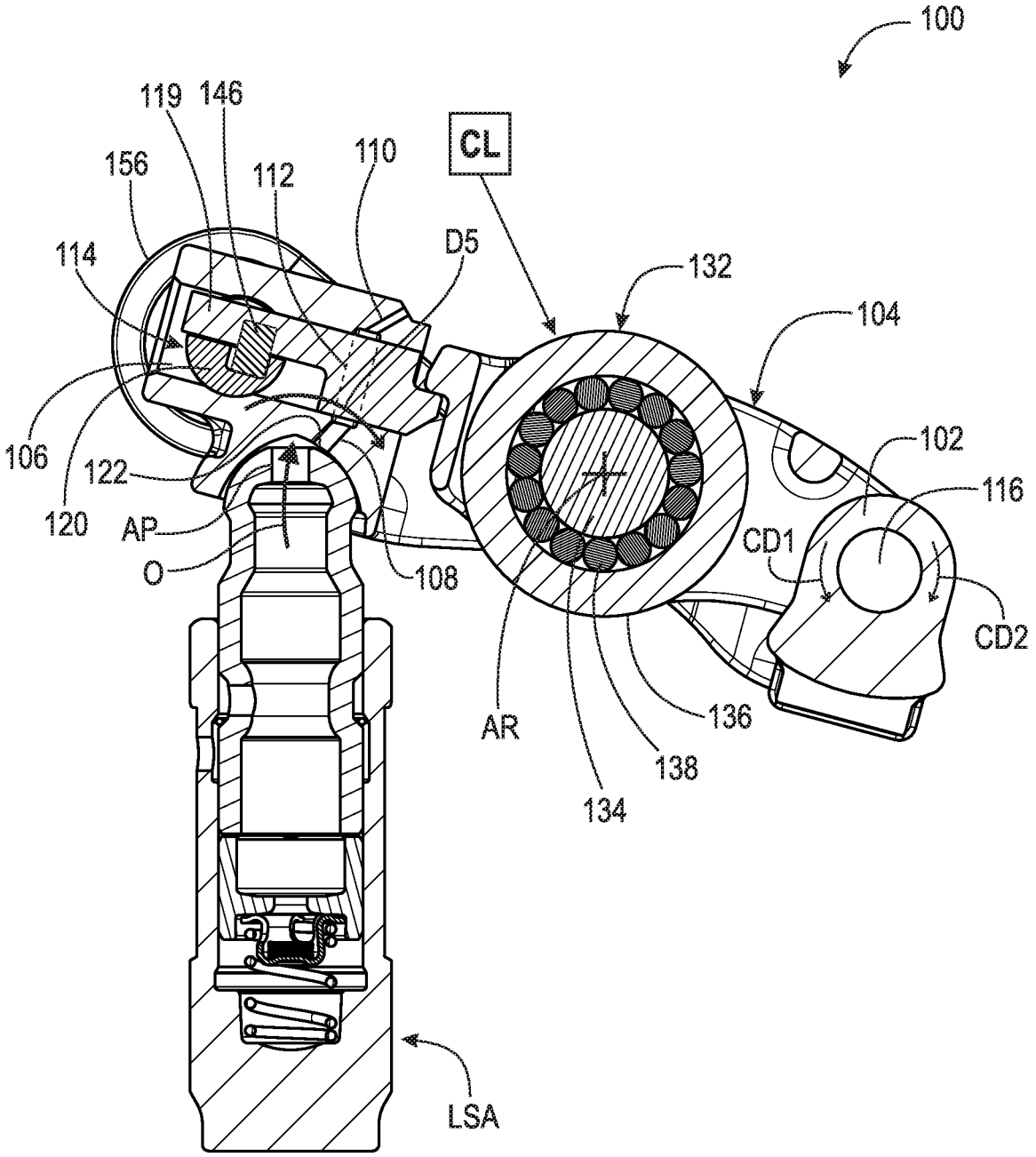
FIG. 10 is a cross-sectional view generally along line 3/6/9-11-3/6/9-11 in FIG. 2, with the switching roller finger follower in the locked configuration with valve lift.

FIG. 10 is a cross-sectional view generally along line 3/6/9-11-3/6/9-11 in FIG. 2, with switching roller finger follower 100 in the locked configuration with valve lift.

Figure 11:
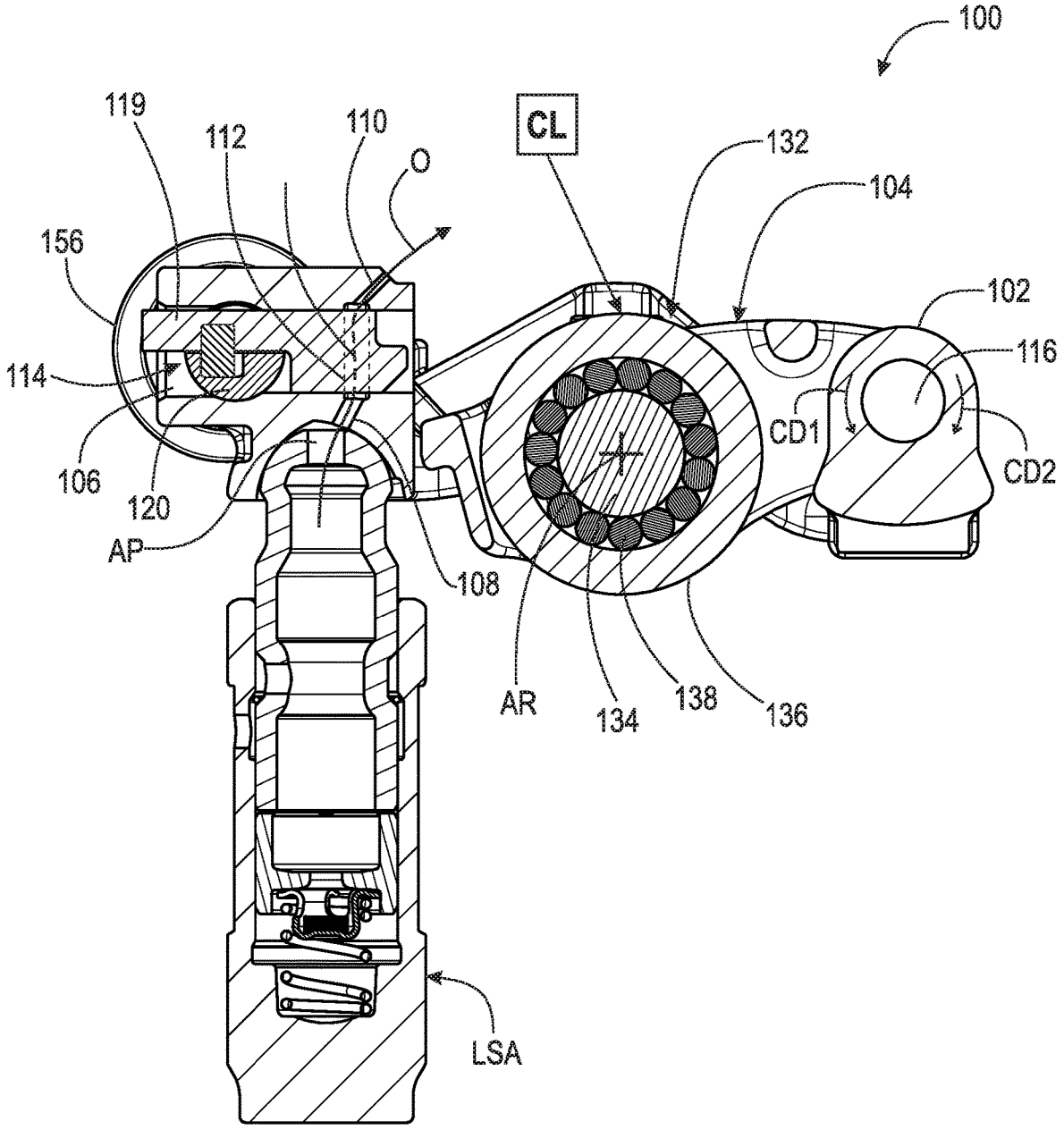
FIG. 11 is a cross-sectional view generally along line 3/6/9-11-3/6/9-11 in FIG. 2, with the switching roller finger follower in the unlocked configuration.

FIG. 11 is a cross-sectional view generally along line 3/6/9-11-3/6/9-11 in FIG. 2, with switching roller finger follower 100 in the unlocked configuration. The following should be viewed in light of FIGS. 1 through 11 and provides further detail regarding operation of switching roller finger follower 100. The position of lash adjuster LSA is fixed in FIGS. 9 through 11. As in known in the art, cam roller 132, in particular outer race 136, is arranged to be contacted by cam lobe CL (schematically represented). In FIG. 9, lobe CL contacts cam roller 132 and oil O flows from lash adjuster LSA through passageway 130 and out orifice 128 to lubricate lobe CL and outer race 136.

To transition from the configuration of FIG. 9 to the configuration of FIG. 10, lobe CL contacts cam roller 132 and pivots follower 100 in direction D5 about lash adjuster LSA. Aperture AP of lash adjuster LSA is mostly out of fluid communication with orifice 122; however, some flow of oil O is possible between adjuster LSA and passageway 130.

To transition from the configuration of FIG. 9 to the configuration of FIG. 11: assembly 114 switches follower 100 from the locked configuration to the unlocked configuration; and lobe CL contacts cam roller 132 and pivots body portion 104 in circumferential direction CD1, opposite circumferential direction CD1, about pin 116 and with respect to body portion 102. Oil O flows from lash adjuster LSA through channel 130 and out orifice 128 of through-bore 110 to lubricate lobe CL and outer race 136.

Channel 130 provides oil O from lash adjuster LSA to lubricate cam roller 132 without interfering with operation of assembly 114, in particular without interfering with operation of locking pin 119. For example, oil O flows through through-bore 108, groove 112, and through-bore 110 and onto cam roller 132 without hindering movement of locking pin 119 within bore 106.

Figure 12:
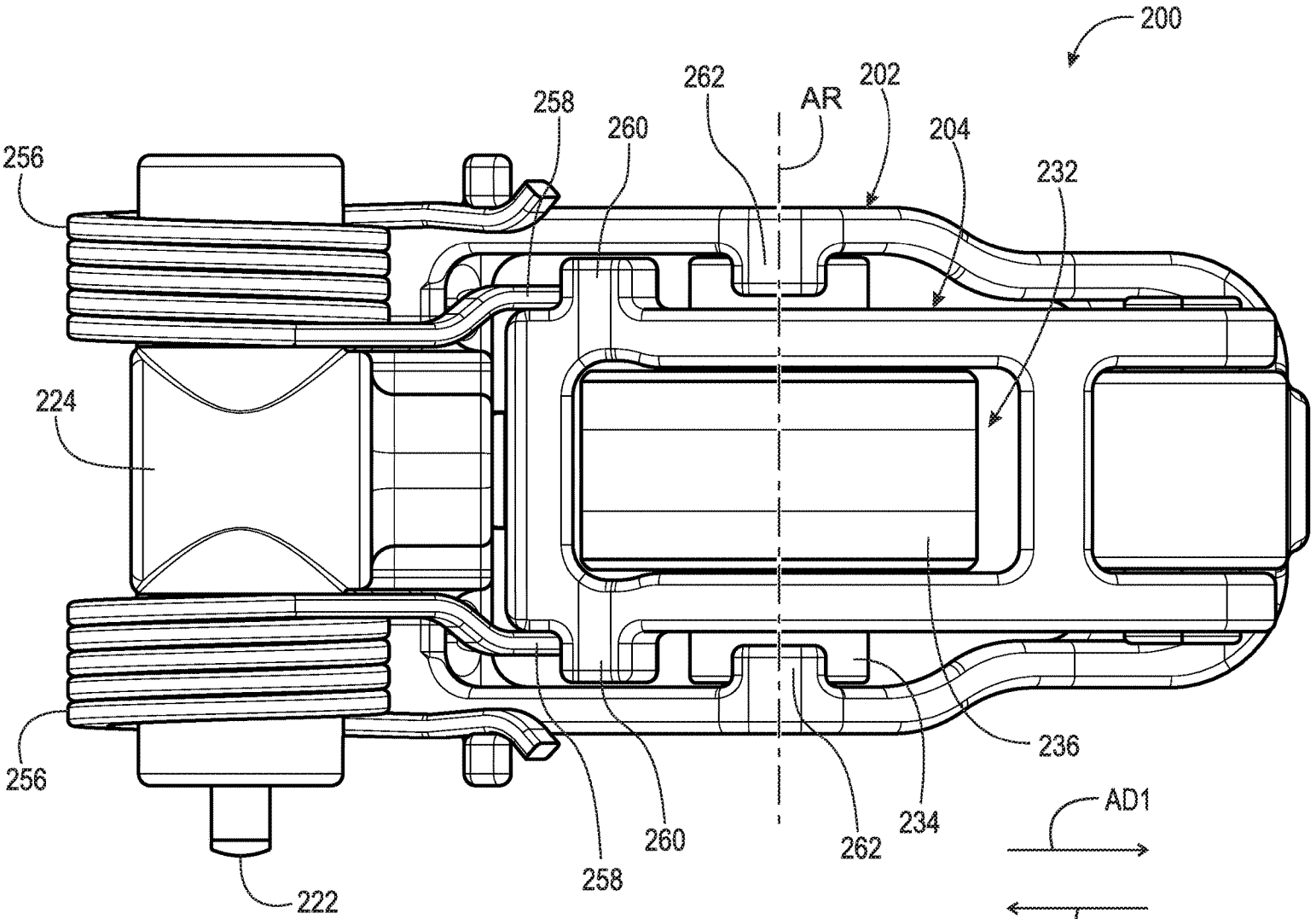
FIG. 12 is a top view of a switching roller finger follower with cam roller lubrication in a locked configuration.

FIG. 12 is a bottom view of switching roller finger follower 200 with cam roller lubrication in a locked configuration.

Figure 13:
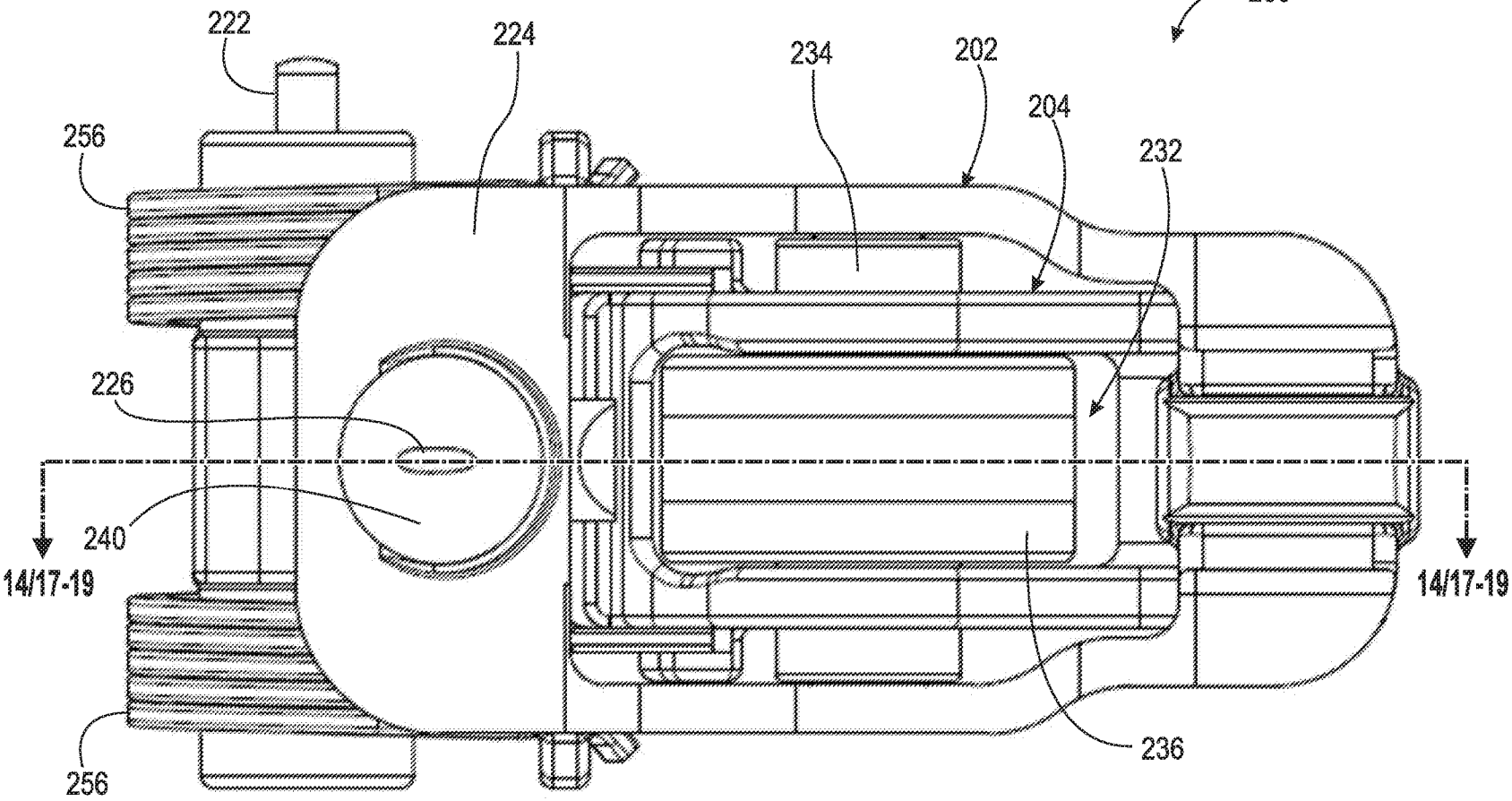
FIG. 13 is a bottom view of the switching roller finger follower in FIG. 12.

FIG. 13 is a top view of switching roller finger follower 200 in FIG. 12.

Figure 14:
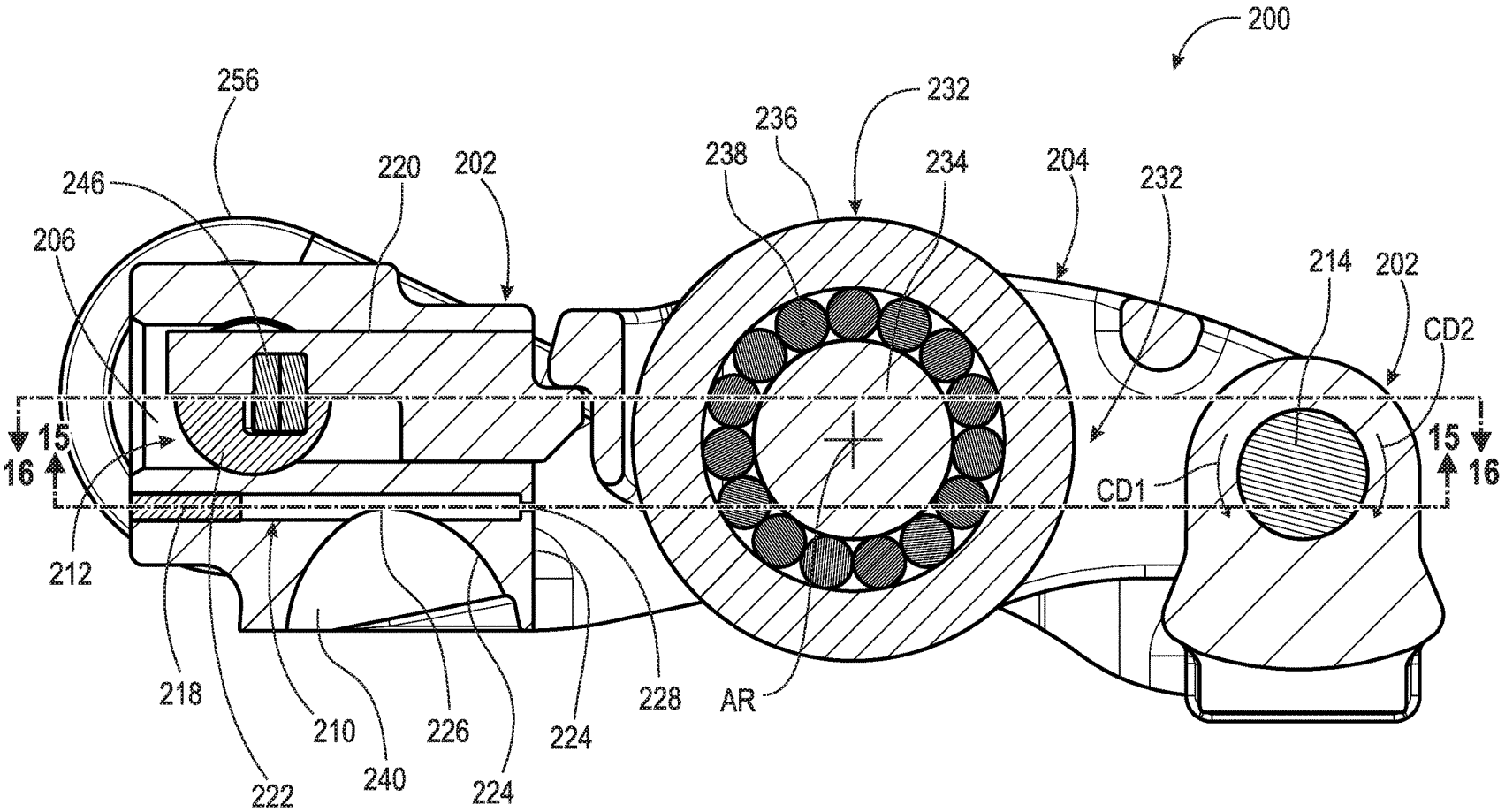
FIG. 14 is a cross-sectional view generally along line 14/17-19-14/17-19 in FIG. 13.

FIG. 14 is a cross-sectional view generally along line 14/17-19-14/17-19 in FIG. 13.

Figure 15:
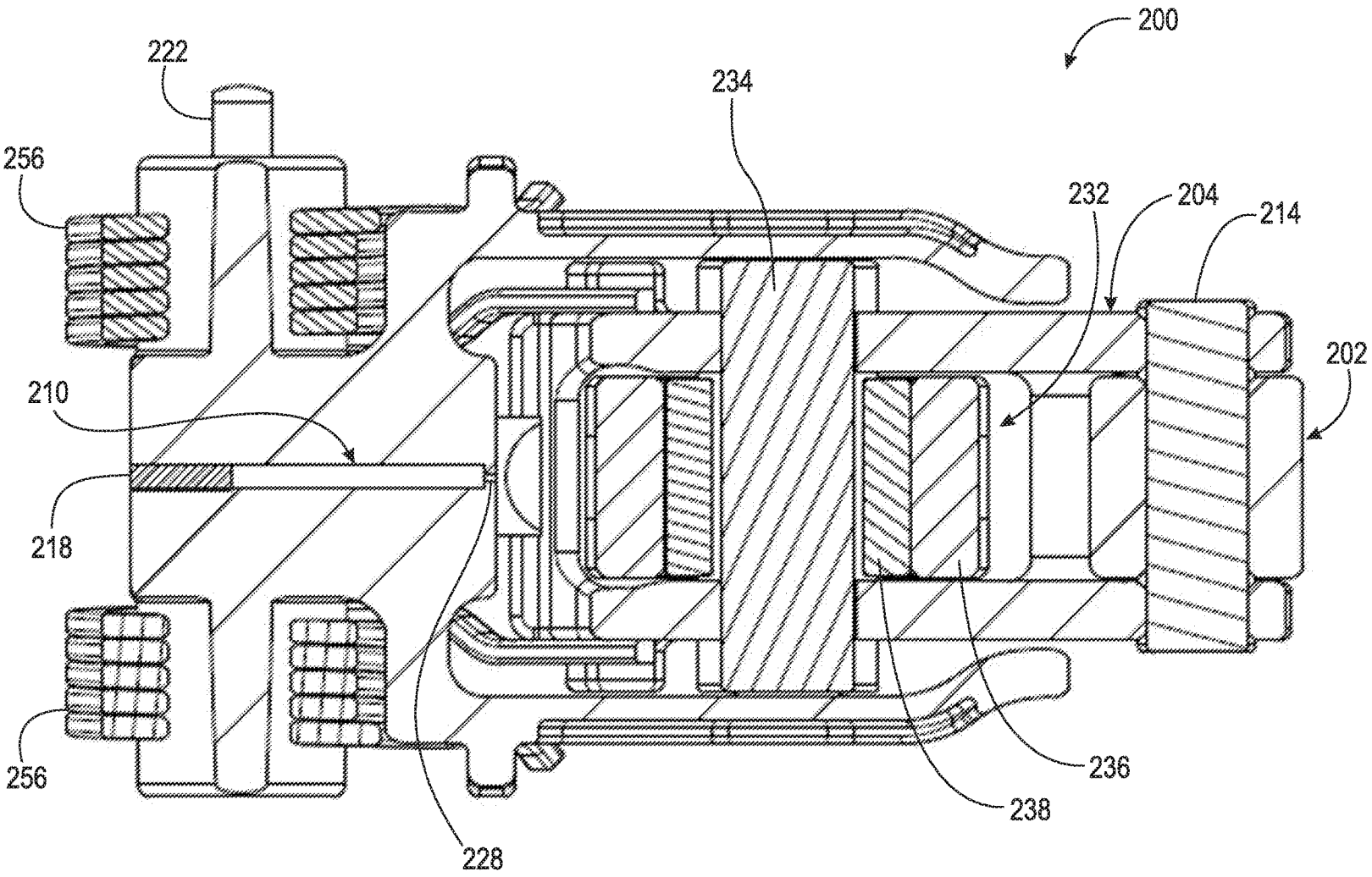
FIG. 15 is a cross-sectional view generally along line 15-15 in FIG. 14.

FIG. 15 is a cross-sectional view generally along line 15-15 in FIG. 12.

Figure 16:
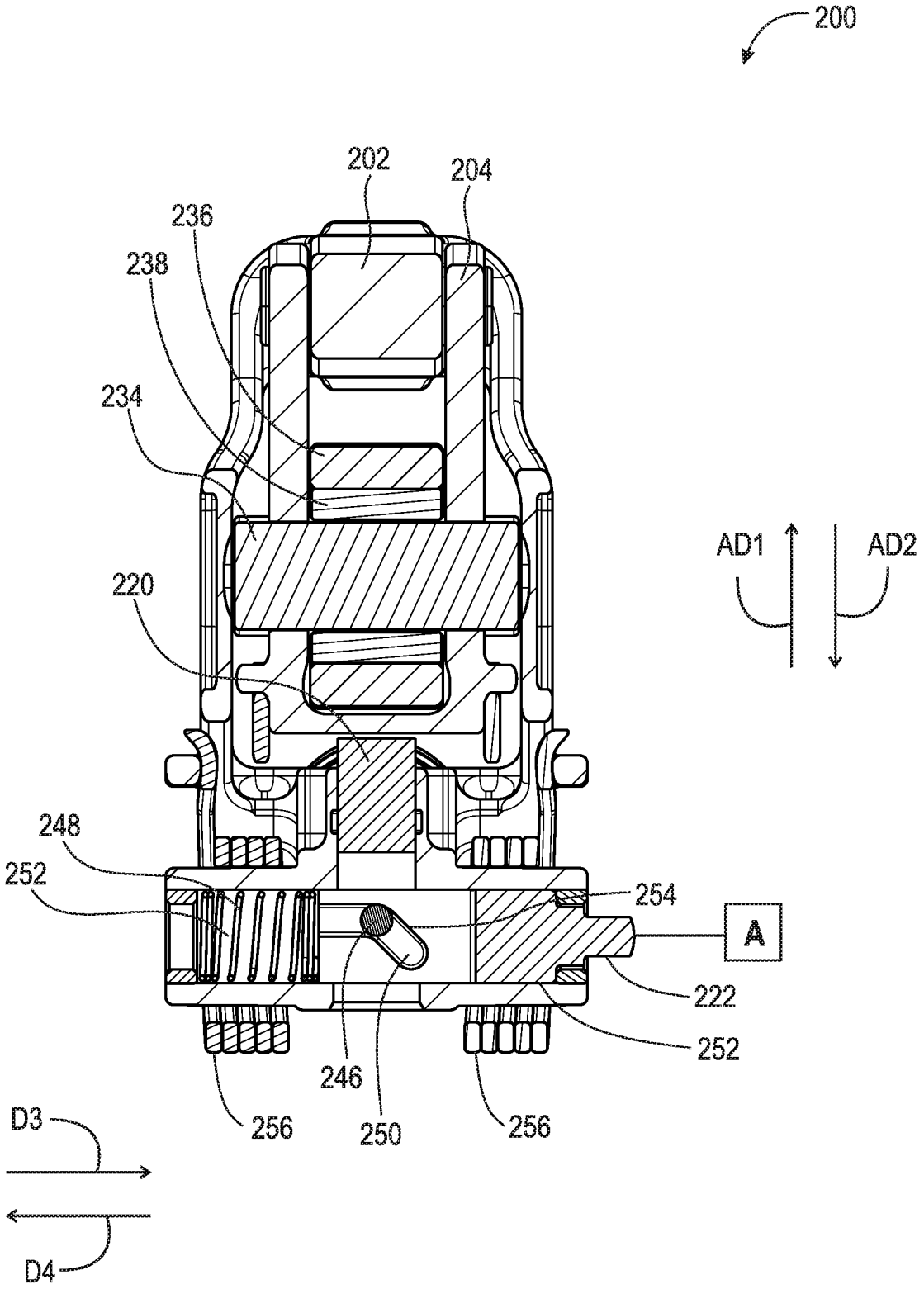
FIG. 16 is a cross-sectional view generally along line 16-16 in FIG. 14.

FIG. 16 is a cross-sectional view generally along line 16-16 in FIG. 14. The following should be viewed in light of FIGS. 12 through 16. Finger follower 200 includes: body portion, or lever, 202; body portion, or lever, 204; bore 206 in portion 202; bore 210 in portion 202; locking assembly 212 disposed, at least in part, in bore 206; and pin 214 pivotably connecting portion 204 to portion 202.

In an example embodiment, bore 206 is a through-bore. Portion 202 includes side wall 216, which bounds bore 206. Bore 206 includes longitudinal axis LA1. In an example embodiment: bore 210 includes longitudinal axis LA2; and plug 218 blocks one end of bore 210. Axis LA2 is non-colinear with axis LA2. In an example embodiment, axis LA2 is parallel to axis LA1.

Locking assembly 210 includes: locking pin 220 and shuttle pin 222. Pin 222 is: transverse to locking pin 220; engaged with locking pin 220; and arranged to be displaced to transverse to locking pin 220 Displacing pin 222 transverse to pin 220: displaces locking pin 220 in a axial direction AD1, parallel to longitudinal axis LA1, to contact body portion 204 with locking pin 220 (place switching roller finger follower 200 in a locked configuration); and displaces locking pin 220 in axial direction AD2, opposite direction AD1, to disengage locking pin 220 from body portion 204 (place switching roller finger follower 200 in an unlocked configuration). Pin 220 does not include bore 210; therefore, bore 210 is fixed with respect to body portion 202.

In the locked configuration, locking pin 220 prevents portion 204 from pivoting about pin 214, and with respect to portion 202, in circumferential direction CD1. In the unlocked configuration of switching roller finger follower 200, pin 220 does not block body portion 204 from pivoting about pin 214 and with respect to body portion 202. In an example embodiment, in the unlocked configuration, body portion 204 is free of contact with locking assembly 212. It is possible for pin 214 to be fixed to portion 204 such that portion 204 and pin 214 pivot with respect to portion 202.

Body portion 202 includes outer surface 224. Bore 210 includes: orifice 226 in outer surface 224; and orifice 228 in outer surface 224.

In the example of FIG. 12, finger follower 200 includes cam roller 232 with: axle 234 fixed to portion 204; outer race 236; and rollers 238 radially disposed between axle 234 and race 236. In the example of FIG. 12, body portion 202 includes indentation 240 arranged to receive lash adjuster LSA and orifice 226 is at indentation 240. That is, bore 210 opens to indentation 240 at orifice 226.

Figure 17:
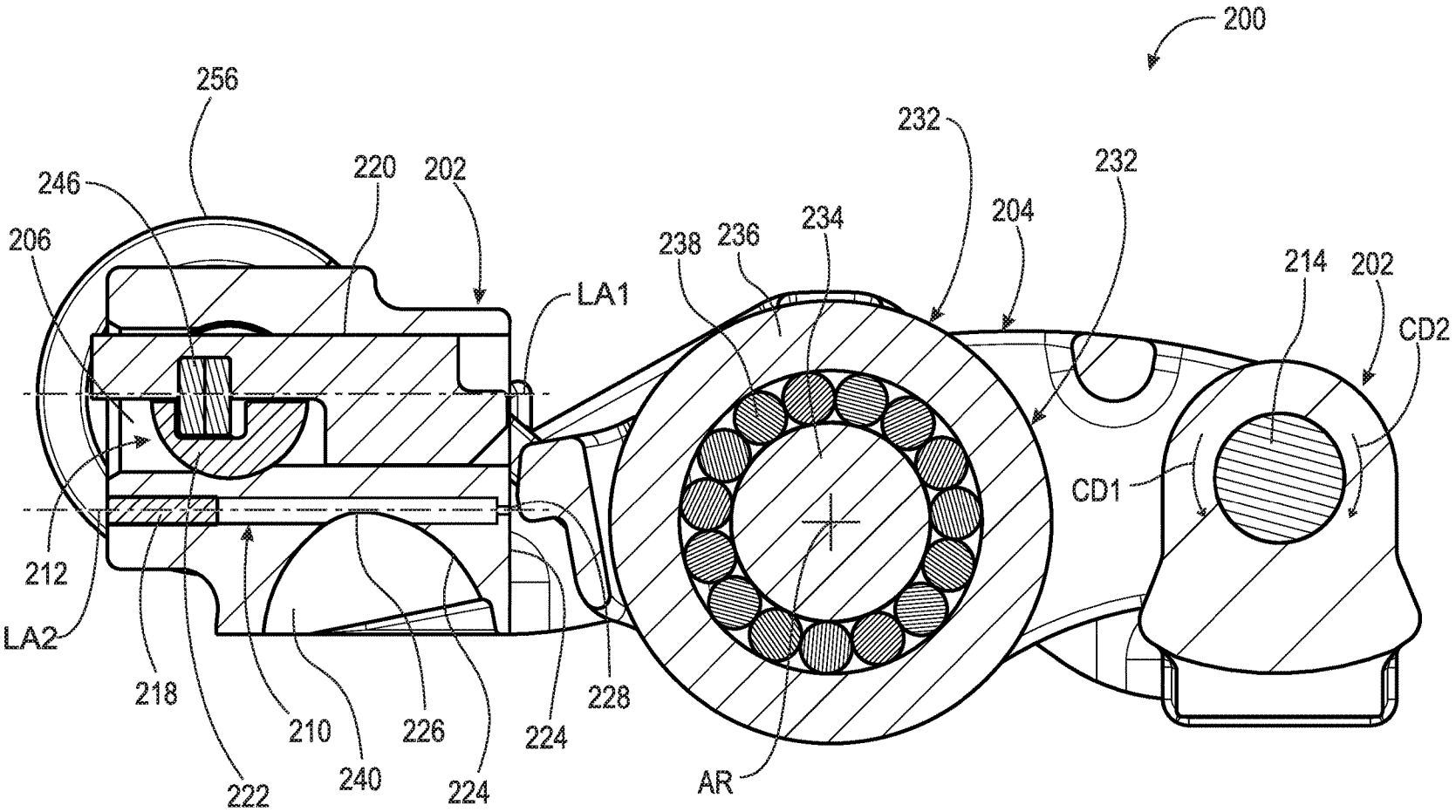
FIG. 17 is a cross-sectional view generally along line 14/17-19-14/17-19 in FIG. 13 with the switching roller finger follower in an unlocked configuration.

FIG. 17 is a cross-sectional view generally along line 14/17-19-14/17-19 in FIG. 13 with switching roller finger follower 200 in an unlocked configuration. The following should be viewed in light of FIGS. 12 through 16. In the example of FIG. 12, locking assembly 214 includes switching pin 246 and resilient element 248. Switching pin 246 is fixedly connected to locking pin 220 and extends into ramped slot 250 in shuttle pin 222. Pin 222 is: disposed at least partly in bore 206; disposed at least partly in through-bores 252 in body portion 202; and is engaged with pin 246 via slot 250. Resilient element 248 urges shuttle pin 222 in direction D3, orthogonal to axis LA. In an example embodiment (not shown), a switching pin is fixedly connected to shuttle pin 222 and extends into a ramped slot in locking pin 220.

In the example of FIG. 12, follower 200 includes resilient elements 256 wrapped about body portion 202 and urging body portion 204 in direction CD1 about pin 214. In the example of FIG. 12, shuttle pin 222 is arranged to be displaced by actuator A in direction D4, opposite direction D3, against force from resilient element 248. Resilient element 248 and actuator A switch follower 200 between the locked configuration and the unlocked configuration. For example, starting in the locked configuration shown in FIG. 13, when actuator A displaces shuttle pin 222 in direction D4, contact with wall 254 of slot 250 forces pin 246 and locking pin 220 in direction AD2 and into the unlocked configuration of FIG. 14. For example, starting in the unlocked configuration shown in FIG. 14, when resilient element 248 displaces shuttle pin 222 in direction D3, contact with wall 254 forces pin 246 and locking pin 220 in direction AD1 and resilient elements 256 pivot body portion 204, about pin 214 and with respect to portion 202, and into the locked configuration shown FIG. 13. Actuator A can be any actuator known in the art. In an example embodiment (not shown), resilient element 248 displaces shuttle pin 222 in direction D4 and actuator A is arranged to displace shuttle pin 222 in direction D3.

Ends 258 of resilient elements 256 contact shoulders 260 of portion 204 to urge portion 204 in circumferential direction CD1 with respect to pin 214 and body portion 202. Axle 234 contacts stops 262 in body portion 202 to limit an extent of pivoting of body portion 204 in direction CD1.

Figure 18:
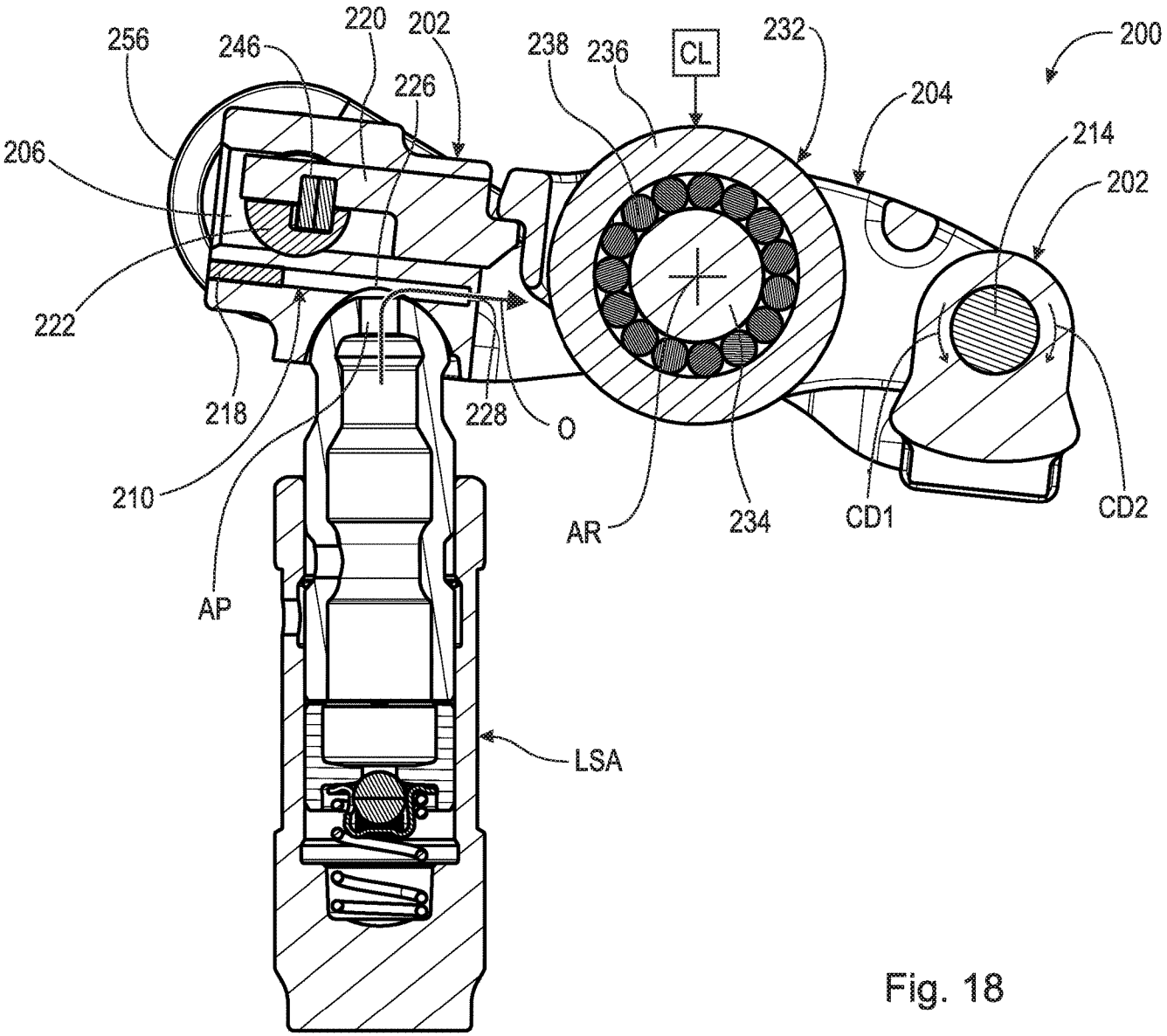
FIG. 18 is a cross-sectional view generally along line 14/17-19-14/17-19 in FIG. 13, with a lash adjuster without valve lift.

FIG. 18 is a cross-sectional view generally along line 14/17-19-14/17-19 in FIG. 13, with lash adjuster LSA without valve lift. The following should be viewed in light of FIGS. 12 through 18 and provides further detail regarding operation of switching roller finger follower 200. The position of lash adjuster LSA is fixed in FIG. 18. As in known in the art, cam roller 232, in particular outer race 236, is arranged to be contacted by cam lobe CL (schematically represented). In FIG. 18, lobe CL contacts cam roller 232 and oil O flows from lash adjuster LSA through bore 210 and out orifice 228 to lubricate lobe CL and outer race 236.

Figure 19:
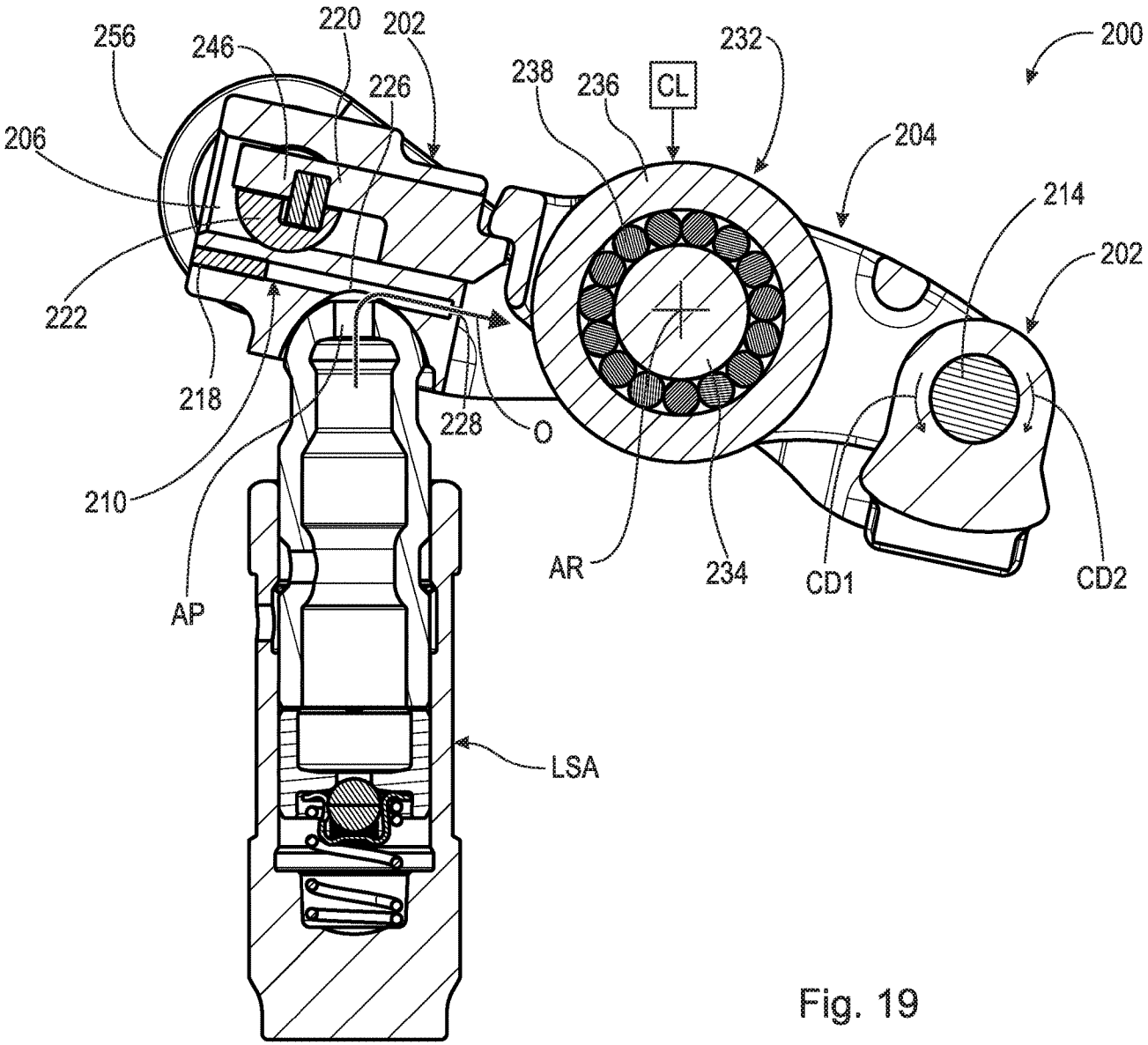
FIG. 19 is a cross-sectional view generally along line 14/17-19-14/17-19 in FIG. 13, with the lash adjuster with valve lift; and, FIG. 20 is a perspective view of a cylindrical coordinate system demonstrating spatial terminology used in the present application.

FIG. 19 is a cross-sectional view generally along line 14/17-19-14/17-19 in FIG. 13, with a lash adjuster with valve lift. The following should be viewed in light of FIGS. 12 through 19. To transition from the configuration of FIG. 18 to the configuration of FIG. 19, lobe CL contacts cam roller 232 and pivots follower 200 in direction D5 about lash adjuster LSA. Aperture AP remains in fluid communication with orifice 228.

The discussion for FIG. 11 is generally applicable to follower 200 in the unlocked mode. For example, when follower 200 is in the unlocked mode, the position of follower 200 is substantially the same as the position of follower 100 shown in FIG. 11.

Bore 210 provides oil O from lash adjuster LSA to lubricate cam roller 232 without interfering with operation of assembly 212, in particular without interfering with operation of locking pin 220. For example, oil O flows through aperture AP, orifice 226, and bore 210 to be expelled through orifice 228 onto cam roller 232 without hindering movement of locking pin 220 within bore 206. In an example embodiment, due to the configuration of orifice 226 and aperture AP, oil O is able to flow from lash adjuster LSA to bore 210 when follower 200 is in the locked position with valve lift.

The following should be viewed in light of FIGS. 1 through 11. The following describes a method of operating switching roller finger follower 100. Although the method is presented as a sequence of steps for clarity, no order should be inferred from the sequence unless explicitly stated. A first step displaces shuttle pin 120 in direction D3. A second step displaces, with shuttle pin 120, locking pin 119 in axial direction AD1. A third step contacts body portion 104 with locking pin 119. A fourth step displaces shuttle pin 120 in a direction D4. A fifth step displaces, with shuttle pin 120, locking pin 119 in axial direction AD2. A sixth step disengages locking pin 119 from body portion 104. A seventh step receives pressurized fluid O with orifice 122. An eighth step transmits pressurized fluid O through through-bore 108, not including the orifice 128 and in fluid communication with orifice 128. A ninth step expels pressurized fluid O through orifice 128.

In an example embodiment: displacing shuttle pin 120 in direction D3 includes displacing shuttle pin 120 with resilient element 148; and displacing shuttle pin 120 in a direction D4 includes displacing shuttle pin 120 with actuator A.

The following should be viewed in light of FIGS. 12 through 14. The following describes a method of operating switching roller finger follower 200. Although the method is presented as a sequence of steps for clarity, no order should be inferred from the sequence unless explicitly stated. A first step displaces shuttle pin 222 in direction D3. A second step displaces, with shuttle pin 222, locking pin 220 in axial direction AD1. A third step contacts body portion 204 with locking pin 220. A fourth step displaces shuttle pin 222 in a direction D4. A fifth step displaces, with shuttle pin 222, locking pin 220 in axial direction AD2. A sixth step disengages locking pin 220 from body portion 204. A seventh step receives pressurized fluid O with orifice 126. An eighth step transmits pressurized fluid O through bore 210. A ninth step expels pressurized fluid O through orifice 228.

In an example embodiment: displacing shuttle pin 222 in direction D3 includes displacing shuttle pin 222 with resilient element 248; and displacing shuttle pin 222 in a direction D4 includes displacing shuttle pin 222 with actuator A.

The following should be viewed in light of FIGS. 1 through 11. The following describes a method of operating switching roller finger follower 100. Although the method is presented as a sequence of steps for clarity, no order should be inferred from the sequence unless explicitly stated. A first step displaces shuttle pin 120 in direction D3. A second step displaces, with shuttle pin 120, locking pin 119 in axial direction AD1. A third step contacts body portion 104 with locking pin 119. A fourth step displaces shuttle pin 120 in a direction D4. A fifth step displaces, with shuttle pin 120, locking pin 119 in axial direction AD2. A sixth step disengages locking pin 119 from body portion 104. A seventh step receives pressurized fluid O with orifice 122. An eighth step transmits pressurized fluid O through passageway 130. A ninth step expels pressurized fluid O through orifice 128.

In an example embodiment: displacing shuttle pin 120 in direction D3 includes displacing shuttle pin 120 with resilient element 148; and displacing shuttle pin 120 in a direction D4 includes displacing shuttle pin 120 with actuator A.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE CHARACTERS

10 cylindrical system
11 axis of rotation
AD1 axial direction
AD2 axial direction
RD1 radial direction
RD2 radial direction
CD1 circumferential direction
CD2 circumferential direction
R radius
12 object
13 object
14 object
15A surface
15B surface
15C edge
16A surface

16B edge
17A radius
17B radius
18 surface
19 circumference
20 radius
A actuator
AR axis of rotation
C circle
CL cam lobe
D1-D5 direction
L1 line
L2 line
LA longitudinal axis
LA1 longitudinal axis
LA2 longitudinal axis
LSA lash adjuster
O pressurized fluid, oil
P1 plane
P2 plane
100 switching roller finger follower
102 body portion
104 body portion
106 bore
108 through-bore
110 through-bore
112 groove
114 locking assembly
116 pin
118 side wall
119 locking pin
119A portion, locking pin
119B portion, locking pin
119C portion, locking pin
120 shuttle pin
121 outer surface
122 end, through-bore 108
124 end, through-bore 108
126 end, through-bore 110
128 end, through-bore 110
130 continuous passageway
132 cam roller
134 axle
136 outer race
138 roller
140 indentation
146 switching pin
148 resilient element
150 ramped slot
152 through-bore
154 wall, slot 150
156 resilient element
158 end, resilient element 156
160 shoulder, portion 104
162 stop, portion 102
200 switching roller finger follower
202 body portion
204 body portion
206 bore
210 bore
212 locking assembly
214 pin
216 side wall
218 plug
220 locking pin
222 shuttle pin
224 outer surface
226 orifice, bore 210
228 orifice, bore 210
232 cam roller
234 axle
236 outer race
238 roller
240 indentation
246 switching pin
248 resilient element
250 ramped slot
252 through-bore
254 wall, slot 250
256 resilient element
258 end, resilient element 256
260 shoulder, portion 204
262 stop, portion 202

The invention claimed is:

1. A switching roller finger follower, comprising:
a first body portion including:
a first bore including a first longitudinal axis;
an outer surface;
a second bore including a first orifice in the outer surface, the first orifice arranged to receive a pressurized fluid; and,
a second orifice in the outer surface, the second orifice arranged to expel the pressurized fluid;
a second body portion;
a pin pivotably connecting the second body portion to the first body portion;
at least one first resilient element connected to the first body portion and to the second body portion; and,
a locking assembly including:
a locking pin at least a portion of which is disposed in the first bore; and,
a shuttle pin:
at least a portion of which is disposed in the first body;
transverse to the locking pin;
engaged with the locking pin; and,
arranged to be displaced transverse to the locking pin to:
displace the locking pin in a first axial direction, parallel to the first longitudinal axis, to contact the second body portion with the locking pin; and,
displace the locking pin in a second axial direction, opposite the first axial direction, to disengage the locking pin from the second body portion, wherein:
the second bore includes the second orifice; or,
the second bore:
does not include the second orifice; and,
is in fluid communication with the second orifice.

2. The switching roller finger follower of claim 1, wherein there is no second resilient element:
in contact with the locking pin; or,
through which the first longitudinal axis passes.

3. The switching roller finger follower of claim 1, wherein:
the second bore:
does not include the second orifice; and,
is in fluid communication with the second orifice;
the first body portion includes:
a side wall bounding the first bore;
a groove in the side wall; and,
a first through-bore including:
the first orifice; and, a second orifice connected to the groove; and,
the second bore:
is a second through-bore; and,
includes a third orifice connected to the groove.

4. The switching roller finger follower of claim 3, wherein the locking pin bounds an entirety of the groove when:
the locking pin is in contact with the second body portion; and,
the locking pin is disengaged from the second body portion.

5. The switching roller finger follower of claim 4, wherein:
a first portion of the locking pin, in contact with the side wall, and a second portion of the locking pin, in contact with the side wall, axially bracket the groove when:
the locking pin is in contact with the second body portion; and,
the locking pin is disengaged from the second body portion.

6. The switching roller finger follower of claim 5, wherein:
the first portion:
is located past the groove in the first axial direction; and,
extends 360 degrees about the first longitudinal axis; and,
the second portion:
is located past the groove in the second axial direction; and,
extends 360 degrees about the first longitudinal axis.

7. The switching roller finger follower of claim 3, wherein a circle, centered on the first longitudinal axis and orthogonal to the first longitudinal axis, passes through the groove without intersecting the locking pin or the first body portion.

8. The switching roller finger follower of claim 3, further comprising:
a continuous passageway:
open only at the first orifice and at the second orifice; from the first orifice to the second orifice; and,
consisting of the first through-bore, the groove, and the second through-bore.

9. The switching roller finger follower of claim 3, wherein:
the locking assembly includes a second resilient element;
the second resilient element is arranged to displace the shuttle pin in a first direction, orthogonal to the first longitudinal axis, to displace the locking pin in the first axial direction; and,
the shuttle pin is arranged to be displaced by an actuator in a second direction, opposite the first direction, to displace the locking pin in the second axial direction.

10. The switching roller finger follower of claim 1, wherein the second bore includes the first orifice and the second orifice.

11. The switching roller finger follower of claim 10, wherein:
the second bore includes a second longitudinal axis; and,
the second longitudinal axis is:
parallel to the first longitudinal axis; and,
non-co-linear with the first longitudinal axis; or,
wherein the second bore is fixed with respect to the first body portion.

12. A method of operating the switching roller finger follower recited in claim 1, comprising:
displacing the shuttle pin, through the first body portion, in a first direction orthogonal to the first longitudinal axis;
displacing, with the shuttle pin, the locking pin in the first axial direction;
contacting the second body portion with the locking pin;
displacing the shuttle pin, through the first body portion, in a second direction opposite the first direction;
displacing, with the shuttle pin, the locking pin in the second axial direction;
disengaging the locking pin from the second body portion;
receiving the pressurized fluid with the first orifice; and,
expelling the pressurized fluid through the second orifice in the second bore; or,
transmitting the pressurized fluid through the second bore, not including the second orifice and in fluid communication with the second orifice, and expelling the pressurized fluid through the second orifice.

13. A switching roller finger follower, comprising:
a first body portion including:
an outer surface;
a bore including a longitudinal axis;
a side wall bounding the bore;
a groove in the side wall;
a first through-bore including a first orifice at the outer surface, the first through-bore arranged to receive a pressurized fluid; and,
a second through-bore including a second orifice at the outer surface, the second orifice arranged to expel the pressurized fluid;
a second body portion;
a pin pivotably connecting the second body portion to the first body portion;
at least one first resilient element connected to the first body portion and to the second body portion;
a passageway:
open only at the first orifice and at the second orifice; and,
from the first orifice to the second orifice through the groove; and,
a locking assembly including:
a locking pin at least a portion of which is disposed in the bore; and,
a shuttle pin:
at least a portion of which is disposed in the first body portion;
transverse to the locking pin;
engaged with the locking pin; and,
arranged to be displaced:
in a first direction, orthogonal to the longitudinal axis, to displace the locking pin in a first axial direction, parallel to the longitudinal axis, to contact the second body portion with the locking pin; and,
in a second direction, opposite the first direction, to displace the locking pin in a second axial direction, opposite the first axial direction, to disengage the locking pin from the second body portion.

14. The switching roller finger follower of claim 13, wherein:
the locking assembly includes a second resilient element;
the second resilient element is arranged to displace the shuttle pin in the first direction to displace the locking pin in the first axial direction; and, the shuttle pin is arranged to be displaced by an actuator in the second direction to displace the locking pin in the second axial direction.

15. The switching roller finger follower of claim 14, wherein:

a first portion of the locking pin, in contact with the side wall, and a second portion of the locking pin, in contact with the side wall, bracket the groove when:

the locking pin is in contact with the second body portion; and, the locking pin is disengaged from the second body portion;

the first portion is located past the groove in the first axial direction and extends 360 degrees about the longitudinal axis; and, the second portion is located past the groove in the second axial and extends 360 degrees about the longitudinal axis.

16. A method of operating the switching roller finger follower recited in claim 13, comprising:

displacing the shuttle pin, through the first body portion, in the first direction;

displacing, with the shuttle pin, the locking pin in the first axial direction;

contacting the second body portion with the locking pin;

displacing the shuttle pin, through the first body portion, in the second direction;

displacing, with the shuttle pin, the locking pin in the second axial direction;

disengaging the locking pin from the second body portion;

receiving, with the first orifice, a pressurized fluid;

transmitting the pressurized fluid through the passageway; and, expelling the pressurized fluid from the second orifice.

17. A switching roller finger follower, comprising:

a first body portion including:

a first bore including a first longitudinal axis;

an outer surface;

a second bore including:

a first orifice in the outer surface, the first orifice arranged to receive a pressurized fluid;

a second orifice in the outer surface, the second orifice arranged to expel the pressurized fluid; and, a second longitudinal axis, the second longitudinal axis non-co-linear with the first longitudinal axis;

a second body portion;

a pin pivotably connecting the second body portion to the first body portion;

at least one first resilient element connected to the first body portion and to the second body portion; and, a locking assembly including:

a locking pin at least a portion of which is disposed in the first bore; and, shuttle pin:

at least a portion of which is disposed in the first body portion;

transverse to the locking pin;

engaged with the locking pin; and, in a first direction, orthogonal to the first longitudinal axis, to displace the locking pin in a first axial direction, parallel to the first longitudinal axis, to contact the second body portion with the locking pin; and, in a second direction, opposite the first direction, to displace the locking pin in a second axial direction, opposite the first axial direction, to disengage the locking pin from the second body portion.

18. The switching roller finger follower of claim 17, wherein:

the locking assembly includes a second resilient element;

the second resilient element is arranged to displace the shuttle pin in the first direction to displace the locking pin in the first axial direction; and, the shuttle pin is arranged to be displaced by an actuator in the second direction to displace the locking pin in the second axial direction.

19. The switching roller finger follower of claim 17, wherein there is no resilient element:

in contact with the locking pin; or, through which the first longitudinal axis passes.

20. A method of operating the switching roller finger follower recited in claim 17, comprising:

displacing the shuttle pin, through the first body portion, in the first direction;

displacing, with the shuttle pin, the locking pin in the first axial direction;

contacting the second body portion with the locking pin;

displacing, with an actuator, the shuttle pin, through the first body portion, in the second direction;

displacing, with the shuttle pin, the locking pin in the second axial direction;

disengaging the locking pin from the second body portion;

receiving, with the first orifice, a pressurized fluid;

transmitting the pressurized fluid through the second bore; and, expelling the pressurized fluid from the second orifice.

* * * * *